US011052522B2

(12) United States Patent
Ishikawa et al.

(10) Patent No.: US 11,052,522 B2
(45) Date of Patent: Jul. 6, 2021

(54) DRIVING TOOL

(71) Applicant: MAKITA CORPORATION, Anjo (JP)

(72) Inventors: Naoharu Ishikawa, Anjo (JP); Junpei Kamimoto, Anjo (JP)

(73) Assignee: MAKITA CORPORATION, Anjo (JP)

( * ) Notice: Subject to any disclaimer, the term of this patent is extended or adjusted under 35 U.S.C. 154(b) by 136 days.

(21) Appl. No.: 16/483,826

(22) PCT Filed: Feb. 23, 2018

(86) PCT No.: PCT/JP2018/006703

§ 371 (c)(1),
(2) Date: Aug. 6, 2019

(87) PCT Pub. No.: WO2018/159491

PCT Pub. Date: Sep. 7, 2018

(65) Prior Publication Data

US 2019/0389045 A1 Dec. 26, 2019

(30) Foreign Application Priority Data

Mar. 1, 2017 (JP) ..... JP2017-038479

(51) Int. Cl.
*B25C 1/04* (2006.01)
*B25C 5/11* (2006.01)
*B25C 7/00* (2006.01)

(52) U.S. Cl.
CPC ..... *B25C 1/043* (2013.01); *B25C 1/047* (2013.01); *B25C 5/11* (2013.01); *B25C 7/00* (2013.01)

(58) Field of Classification Search
CPC ..... B25C 1/0043; B25C 1/047; B25C 5/11; B25C 7/00
(Continued)

(56) References Cited

U.S. PATENT DOCUMENTS 4,679,719 A * 7/1987 Kramer ..... B25C 1/04 227/131
5,732,870 A 3/1998 Moorman et al.
(Continued)

FOREIGN PATENT DOCUMENTS

JP H08-276375 A 10/1996
JP H09-507172 A 7/1997
(Continued)

OTHER PUBLICATIONS

Nov. 4, 2020 Office Action issued in Japanese Patent Application No. 2017-038479.
(Continued)

*Primary Examiner* — Nathaniel C Chukwurah
(74) *Attorney, Agent, or Firm* — Oliff PLC

(57) ABSTRACT

A driving tool having a trigger, such that after the trigger is on-operated, a contact restriction member starts to rotate to a lock side while rotation resistance is applied thereto by a rotation resistance applying member. A lock portion enters a lock receiving portion to prohibit an on-operation of a contact arm after a reference time has passed after the on-operation of the trigger. As a result, an inadvertent driving operation can be prevented. A mechanical timer mechanism allows for a timer control to be effected under an environment where electric power cannot be supplied.

17 Claims, 14 Drawing Sheets

(58) Field of Classification Search
USPC ..... 227/5
See application file for complete search history.

(56) References Cited

U.S. PATENT DOCUMENTS

| | | | | |
|---|---|---|---|---|
| 5,772,096 | A * | 6/1998 | Osuka | B25C 1/008 227/130 |
| 5,918,788 | A | 7/1999 | Moorman et al. | |
| 6,382,492 | B1 * | 5/2002 | Moorman | B25C 1/008 227/130 |
| 6,431,425 | B1 | 8/2002 | Moorman et al. | |
| 2008/0017689 | A1 | 1/2008 | Simonelli et al. | |
| 2014/0110450 | A1 | 4/2014 | Moore et al. | |
| 2014/0110452 | A1 | 4/2014 | Moore et al. | |
| 2014/0231485 | A1 | 8/2014 | Bauer | |
| 2018/0117748 | A1 | 5/2018 | Ishikawa et al. | |

FOREIGN PATENT DOCUMENTS

| | | | |
|---|---|---|---|
| WO | 2007/142997 | A2 | 12/2007 |
| WO | 2016/152862 | A1 | 9/2016 |

OTHER PUBLICATIONS

Apr. 17, 2018 International Search Report issued in International Patent Application No. PCT/JP2018/006703.
Apr. 17, 2018 Written Opinion issued in International Patent Application No. PCT/JP2018/006703.

* cited by examiner

DRIVING TOOL

REFERENCE TO RELATED APPLICATION

The present application is a U.S. National Phase entry of, and claims priority to, PCT Application No. PCT/JP2018/006703, filed Feb. 23, 2018 which claims priority of Japanese Patent Application No. 2017-038479, filed Mar. 1, 2017, both of which are incorporated herein by reference in their entireties for all purposes.

TECHNICAL FIELD

The present invention relates to a driving tool, such as a nail gun, etc.

BACKGROUND ART

For example, in nail guns in which compressed air is used as a driving force, a driving operation is configured to be performed by a main body. This operation is performed on the condition that a contact arm provided at a tip end of a nose part of the main body is moved upwards with respect to an injection opening, while the contact arm is being pushed toward a workpiece (an on-operation of the contact arm), and the condition that a trigger is pulled by a fingertip (an on-operation of the trigger). The driving operation is configured so as not to be performed by only one of the above on-operations, thereby preventing an inadvertent driving operation.

Furthermore, in these conventional types of driving tools, various driving operations can be performed. For instance, the driving operations may include a focused driving operation in which the trigger is pulled after the contact arm is on-operated by pushing the contact arm toward the material to be driven, a dragged driving operation in which the trigger is on-operated while the driving tool is moved with the contact arm being on-operated, and a swung driving operation in which the contact arm is turned on/off by moving the driving tool in an up-and-down direction while the trigger is being pulled. In the focused driving and the dragged driving operations, unless the trigger is released after the driving operation is performed, the next driving operation cannot be performed (a single driving mode). On the other hand, in the swung driving operation, a continuous driving operation can be performed while the trigger is being pulled (a continuous driving mode).

A first patent document (U.S. Pat. No. 5,732,870) discloses an electrically controlled solenoid valve that moves a head valve for controlling supply and interruption of compressed air with respect to a driving section. A second patent document (U.S. Patent Publication No. 2014/0110450) and a third patent document (U.S. Patent Publication No. 2014/0110452) each discloses a driving tool in which a single driving and a continuous driving can be selected by using an electrically controlled solenoid valve. By using an electrically controlled solenoid valve (starting valve), driving movements such as the single driving and the continuous driving can be controlled appropriately. However, in each of the first to third patent document, compressed air is used as a part of a power source to move a valve stem of the starting valve. This configuration may take time to perform an on/off movement of the starting valve, which decreases the speed performance of the driving movement.

A fourth patent document (Japanese Patent No. 3287172) discloses a mode switch technique in which each of the on-operations of the contact arm and of the trigger are detected by a micro-switch. An elapsed time after the on-operation of the contact arm is measured by a timer. According to the mode switch technique disclosed in the fourth patent document, a driving operation in the single driving mode can be performed by the on-operation of the contact arm within a predetermined time of the trigger being on-operated.

After a driving movement has been performed, a continuous driving inhibition state can be reset by an off-operation of the trigger. In the continuous driving mode, a driving operation can be repeated on the condition that an on-operation of the contact arm is performed within a predetermined time period of the on-operation of the trigger. In contrast, when the on-operation of the contact arm is not performed within the predetermined time period, as measured by the timer, the on-operation of the contact arm does not cause the tool to perform a driving operation. Instead, the tool is forced into the driving operation inhibition state by locking the contact arm in an off position with a lock pin. According to this mode selection technique, for example in the continuous driving mode, when the tool is carried while the grip is being held with the trigger being on-operated, an inadvertent driving operation can be prevented, even in a case where the contact arm is mistakenly touched to other members.

According to the technique disclosed in the fourth patent document, a manual operation type starting valve is not used, thereby avoiding speed performance problems. However, in a case where a remaining capacity of a battery has decreased and power is not being supplied to a controller, etc. receiving the input signals from the micro-switch or other devices, or in a case where power supply is shut off, the driving operation cannot be performed at all and eventually work has to be stopped. In this respect, the techniques disclosed in the first to third patent documents have the same problem. More precisely, when the electric power supply is interrupted, the starting valve cannot be activated, thereby preventing any driving operation.

The present embodiment was conceived in order to overcome this known problem, and an object of the present invention is to continue performing the driving operation even if, for example, the remaining capacity of the battery used for controlling the devices (power supply) becomes low.

BRIEF SUMMARY

The above problems can be solved, for example by the following disclosure. A first embodiment relates to a driving tool in which a driving operation is performed in a main body of the driving tool. The driving operation is performed on the condition that both an on-operation of a trigger and an on-operation of a contact arm are performed. The driving tool comprises a mechanical timer mechanism that is configured to start to be activated when the trigger is on-operated, without the contact arm being on-operated. The timer mechanism includes a contact restriction member that restricts a movement of the contact arm to an on-position side after a reference time, measured from when the trigger is on-operated, has passed. In the first embodiment, the reference time is configured to be such that the contact restriction member is moved from an unlock position to a lock position during the reference time. The contact arm is allowed to move to the on-position side when the contact restriction member is at the unlock position and is not allowed to move to the on-position side when the contact restriction member is at the lock position.

According to the first embodiment, in a case when the trigger is on-operated before the contact arm, the driving operation is performed if the contact arm is on-operated before the reference time has passed. In contrast, after the reference time has passed, the on-operation of the contact arm is prohibited. Accordingly, the driving operation is prohibited by a timer control. Because of the timer control, for example, when the driving tool is carried with the trigger being on-operated, an inadvertent driving operation in the tool main body can be prevented without fail, even if the contact arm mistakenly touches other members after the reference time has passed.

In the first embodiment, the reference time, which relates to a movement of the contact restriction member from the unlock position to the lock position, is set. The reference time is equal to a time period when the contact restriction member moves from the unlock position to the lock position. When the contact restriction member is positioned at the lock position, the contact restriction member blocks a movement of the contact arm. As a result, the on-operation of the contact arm is physically prohibited. In this way, the timer mechanism comprises only mechanical configurations that do not need electric power. Thus the driving operation can be performed under an environment where electric power cannot be supplied. The timer mechanism according to the first embodiment is configured to work when the trigger is on-operated at first, and does not work when the contact arm is on-operated at first.

A second embodiment is related to the driving tool according to the first embodiment, adding that the reference time is set by applying movement resistance to the contact restriction member.

According to the second embodiment, a time period while the contact restriction member moves from the unlock position to the lock position can be set in a freely-selected manner, for example by setting a movement resistance of the contact restriction member in an appropriate manner. Thus, the reference time can be set in a freely-selected manner. A movement resistance applying means such as an air damper or an oil damper can be used as a means for applying the movement resistance.

A third embodiment is related to the driving tool according to the second embodiment, adding that the movement resistance is not applied to the contact restriction member when the contact restriction member returns from the lock position to the unlock position.

According to the third embodiment, a state in the timer control can be returned to the initial state in a rapid manner. Thus, operability and workability of the driving tool can be improved. In the third embodiment, by using, for example, a one-way clutch, the movement resistance can be applied to the contact restriction member when it moves in only one direction (e.g., movement from the unlock position to the lock position).

A fourth embodiment is related to the driving tool according to any one of the first to third embodiments, adding that between the unlock position and the lock position of the contact restriction member, the contact restriction member is forced to be returned to the unlock position by the movement of the contact arm toward the on-position.

According to the fourth embodiment, the reference time can be set in an accurate manner.

A fifth embodiment is related to the driving tool according to any one of the first to fourth embodiments, adding that the on-operation of the contact arm prevents the movement of the contact restriction member toward the lock position.

According to the fifth embodiment, at a time when the contact arm is on-operated, the timer mechanism stops. Furthermore, at a time when the on-operation of the contact arm is released while the trigger is being on-operated, the timer mechanism starts to be activated and, when the reference time has passed, the contact arm cannot be on-operated. The on-operation prohibition state can be released by resetting the timer mechanism. The timer mechanism can be rest when, for example, the on-operation of the trigger is released and the contact arm restriction member is returned to its initial position.

A sixth embodiment is related to the driving tool according to any one of the first to fifth embodiments, adding that an off-position of the trigger moves the contact restriction member toward the unlock position.

According to the sixth embodiment, the timer mechanism can be reset to the initial state by the off-operation of the trigger.

A seventh embodiment is related to the driving tool according to any one of the first to sixth embodiments, adding that the contact restriction member is supported so as to be rotatable between the lock position and the unlock position. Furthermore, when the contact restriction member moves from the unlock position to the lock position, a rotary damper applies rotation resistance to the contact restriction member to set the reference time.

According to the seventh embodiment, the reference time during which the contact restriction member moves from the unlock position to the lock position is set by applying a rotation resistance to the contact restriction member by the rotary damper. The contact restriction member is configured to be rotationally supported and the rotation resistance is configured to be applied to the contact restriction member by the rotary damper. Because of this configuration, the time control can be configured in an easy and compact manner.

A eighth embodiment is related to the driving tool according to the seventh embodiment, adding that a gear engagement or a link mechanism is positioned between the contact restriction member and the rotary damper. This helps set the reference time during which the contact restriction member moves from the unlock position to the lock position.

According to the eighth embodiment, the reference time can be set in a freely-selected manner, for instance by setting acceleration and reduction ratio of the gear engagement or the link mechanism in an appropriate manner.

BRIEF DESCRIPTION OF THE DRAWINGS

FIG. 11 is a longitudinal sectional view of the starting device according to the first embodiment. This figure shows a state in which a contact arm is on-operated before a predetermined time of the timer has passed and a starting valve is tuned on.

FIG. 22 is a longitudinal sectional view of the starting device according to the second embodiment. This figure shows a state in which the contact arm is on-operated before a predetermined time of the timer has passed and the starting valve is turned on.

DETAILED DESCRIPTION

Figure 1:
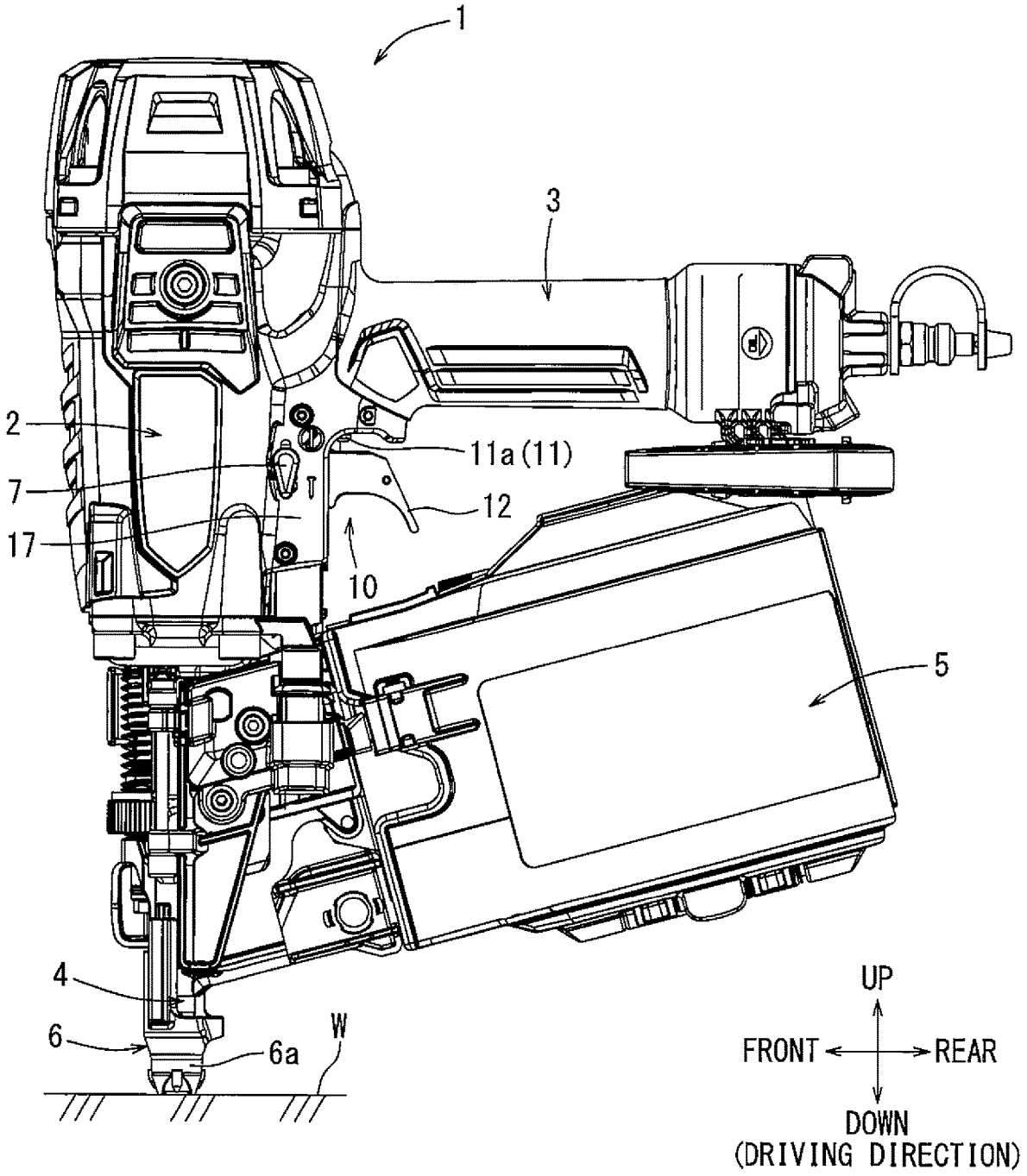
FIG. 1 is an overall lateral view of a driving tool according to an embodiment of the present invention.
Figure 2:
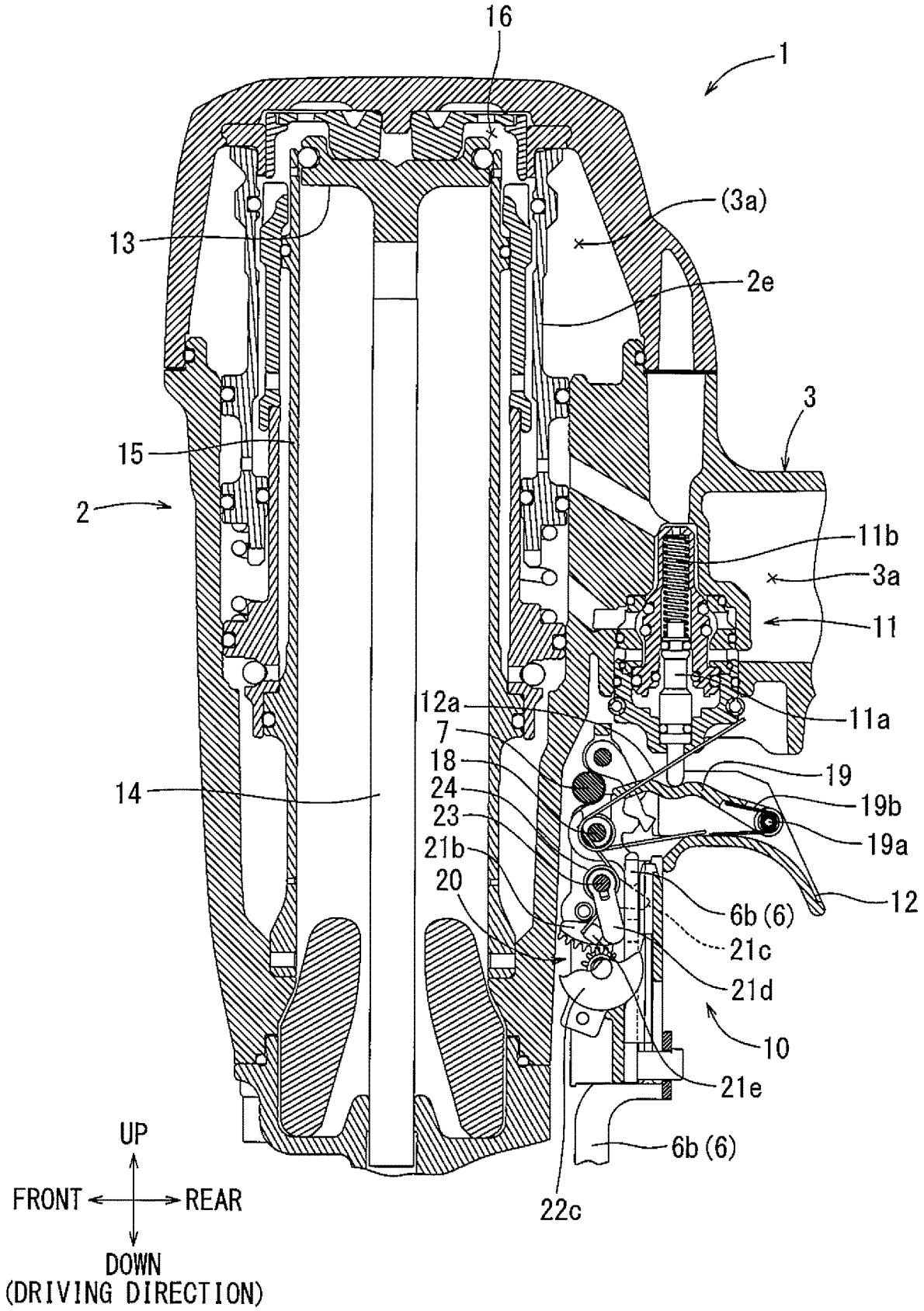
FIG. 2 is a longitudinal sectional view of a tool main body and a starting device of the driving tool according to a first embodiment.
Figure 3:
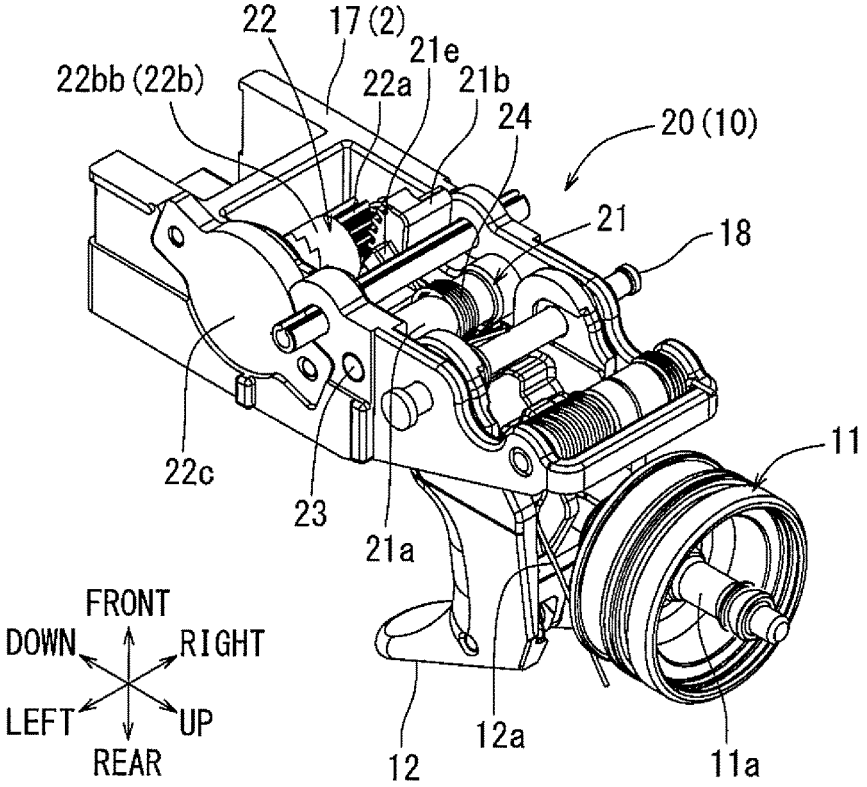
FIG. 3 is a perspective view of the starting device according to the first embodiment.
Figure 4:
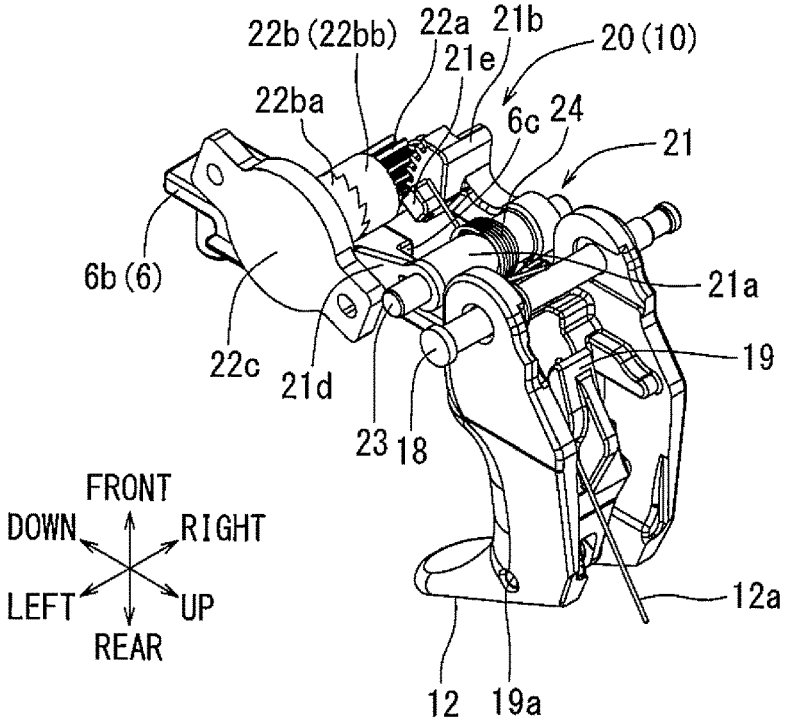
FIG. 4 is a perspective view of the starting device according to the first embodiment. This figure differs from FIG. 3 in that the embodiment of a starting base and a starting valve are removed.

Next, selected embodiments of the present disclosure will be explained based on FIGS. 1 to 26. As shown in FIG. 1 and FIG. 2, in the present embodiment, a compressed-air-driven nail gun is provided as an example of a driving tool 1. The driving tool 1 comprises a main body 2 in which an internally mounted piston 13 reciprocates by a compressed air, a grip 3 that protrudes from a lateral part of the main body 2 in a lateral direction, a nose part 4 which extends from a lower part of the main body 2 in a downward direction (e.g., in a driving direction of members to be driven), and a magazine 5 with which a plurality of members to be driven can be loaded and which is provided straddling the nose part 4 and the grip 3.

At a downward tip end of the nose part 4, a contact arm 6 is supported so as to move relative to the driving tool 1 in an up-down direction. One of the operations for performing a driving operation includes the relative movement of the contact arm 6 in the upward direction when the contact arm 6 is pushed toward a workpiece. The contact arm 6 extends from near the tip end of the nose part 4 to near the location of the trigger 12. At a lower portion of the contact arm 6, an annular-shaped contact portion **6*a* is located around an injection opening at the tip of the nose part 4. A band-plate-shaped extension portion 6*b* may be located at an upper portion of the contact arm 6 and extend towards a trigger 12. The contact arm 6, which integrally includes the contact portion 6*a* and the extension portion 6*b*, is supported so as to be moved in the up-down direction within a predetermined length along the nose part 4**.

A starting device 10 according to the present embodiment is disposed at a lateral part of the main body 2 near a base of the grip 3. A starting valve 11 is turned on by a starting operation of the starting device 10. When the starting valve 11 is turned on, compressed air is supplied to an upper piston chamber 16 of the main body 2. When the compressed air is supplied to the upper piston chamber 16, a piston 13 moves downwards in a cylinder 15. A long rod-shaped driver 14 is attached to a lower surface of the piston 13. By the downward movement of the piston 13, and in turn the movement of the driver 14, one member to be driven is driven out of the tip end (e.g., the injection opening) of the nose part 4. The driven member is supplied one by one to the nose part 4 from the magazine 5.

As shown in FIG. 1, a trigger lock lever 7 is provided in a lateral portion of the starting device 10. When the trigger lock lever 7 is rotated downward as shown in FIG. 1, the trigger 12 can be pulled in an upward direction. On the other hand, when the trigger lock lever 7 is rotated upward, the trigger 12 cannot be pulled in the upward direction, thereby being in a trigger lock state. An inadvertent driving operation of the driving tool 1 can be prevented by selecting the trigger lock lever 7 to the upper side lock position.

The starting device 10 according to the present embodiment possesses unconventional features. A modification is not particularly required with respect to the basic configurations of the driving tool 1 of the present embodiment, and thus detailed explanation will be omitted. For instance, the starting valve 10 possesses a feature that the starting valve 11 can be on-operated on the condition that both the on-operation of the trigger 12 and the on-operation of the contact arm 6 are performed. The starting device 10 of the present embodiment comprises the above-described starting valve 11, the above described trigger 12, and a timer mechanism 20. As shown in FIG. 2, the starting valve 11 is housed on the lower side of the base of the grip 3. A lower portion of a valve stem 11*a* protrudes toward the trigger 12. The valve stem 11*a* of the starting valve 11 is supported so as to be movable in the up-to-down direction (e.g., on-position and off-position). The valve stem 11*a* is biased downward toward the off-position by a compression spring 11*b*. FIG. 2 shows that the valve stem 11*a* is disposed at the off-position. When the valve stem 11*a* is moved from the off-position toward the upward direction against the spring biasing force, the starting valve 11 is turned on.

When the starting valve 11 is turned on, a head valve 2*e* is moved downward, so as to be opened, by the air pressure applied in the downward direction. When the head valve 2*e* is opened, the compressed air that accumulates in an accumulation chamber 3*a* in the grip 3 is supplied to a piston upper chamber 16. When the valve stem 11*a* is returned by moving in the downward direction by the spring biasing force, the starting valve 11 is turned off. When the starting valve 11 is turned off, the head valve 2*e* is moved upward by both the spring force and the air pressure applied in the upward direction. Because of this, the piston upper chamber 16 is closed with respect to the accumulation chamber 3*a*. When the piston upper chamber 16 is closed with respect to the accumulation chamber 3*a*, the piston upper chamber 16 is open to the atmosphere. Thereby, the piston 13 is returned to an upper dead center (e.g., the initial position).

FIGS. 3 to 7 show a detailed embodiment of the trigger 12 and the timer mechanism 20. The trigger 12 and the timer mechanism 20 are supported by a starting base 17 that is integrally formed on the rear surface side of the tool main body 2. The trigger 12 is supported so as to be rotatable in the up-down direction around a support shaft 18. The trigger 12 can be pulled upward (e.g., toward an on-position) by a user's fingertip on the hand by which the grip 3 is held. The trigger 12 is spring biased in the downward direction by a torsion spring 12*a*, so as to be biased to be swung to the off-position. An idler 19 is supported so as to be rotatable in the up-down direction around a support shaft 19*a* on the upper surface side (e.g., on the back surface side) of the trigger 12. The idler 19 is biased by a torsion spring 19*b* in a direction such that its rotation tip end (e.g., on the front side) is moved in the upward direction. The idler 19 is pushed by the biasing force of the torsion spring 19*b* to contact a tip end of the valve stem 11*a* at all times.

The timer mechanism 20 is provided downward of the trigger 12. An extension portion 6*b* of the contact arm 6 is arranged so as to be movable in the up-to-down direction along the rear side of the timer mechanism 20. The timer mechanism 20 includes a contact restriction member 21 that is supported by the starting base 17 on the lower side of the trigger 12 and also includes a timer setting portion 22 that is supported by the starting base 17. The contact restriction member 21 is supported so as to be rotatable in the front-rear direction around a support shaft 23. The contact restriction member 21 includes a support tubular portion 21*a*, formed in a tubular shape, that is supported around a support shaft 23. A gear arm 21*b*, a stopper 21*c*, and a release arm 21*d* are integrally formed with the support tubular portion 21*a*. The gear arm 21*b* extends from the right end of the support tubular portion 21*a* in a direction approximately toward the downward direction. A lock portion 21*e* is integrally formed with the left side of the gear arm 21*b*. As shown in the figures, the lock portion 21*e* is formed in a block shape and protrudes from the left side of the gear arm 21*b* in a lateral direction. The stopper 21*c* extends from the right end of the support tubular portion 21*a* in a direction approximately toward the rearward direction and at an interval of approximately 90 degrees around the support shaft 23 with respect to the gear arm 21*b*. The release arm 21*d* extends obliquely downward from the left end of the support tubular portion 21*a* and at an interval of approximately 45 degrees around the support shaft 23 with respect to the gear arm 21*b*. Mutual positional relationships between the gear arm 21*b*, the stopper 21*c*, and the release arm 21*d* are fixed around the axis of the support tubular portion 21*a*. That is, these three members simultaneously rotate around the support shaft 23.

Figure 6:
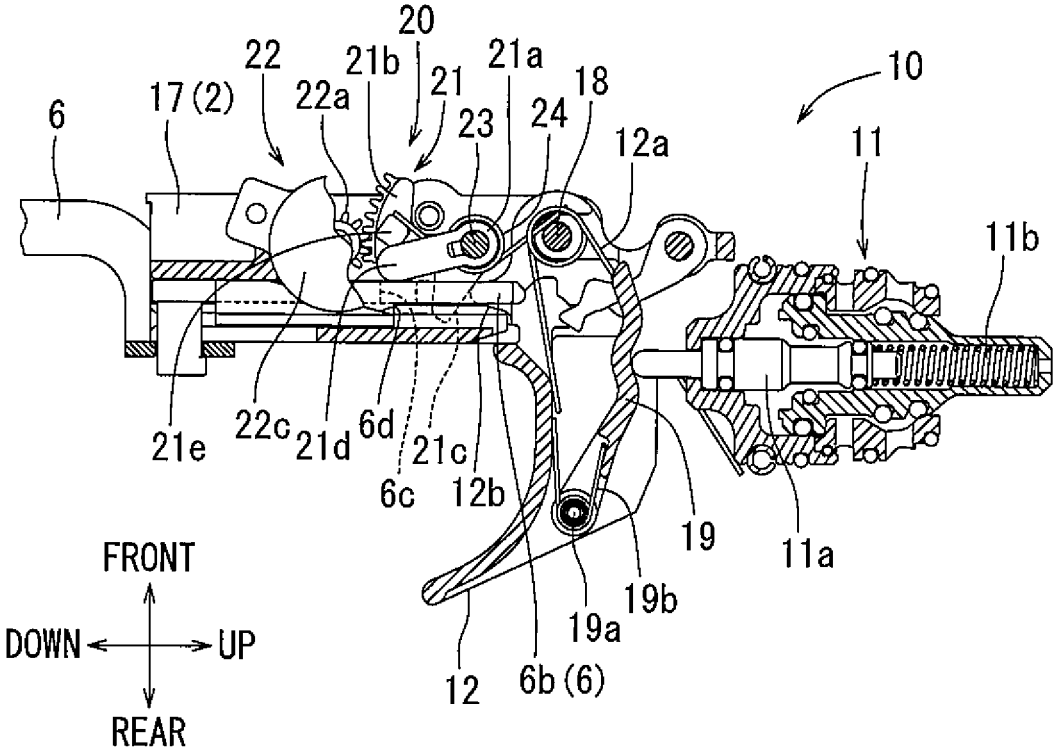
FIG. 6 is a longitudinal sectional view of the starting device according to the first embodiment.
Figure 7:
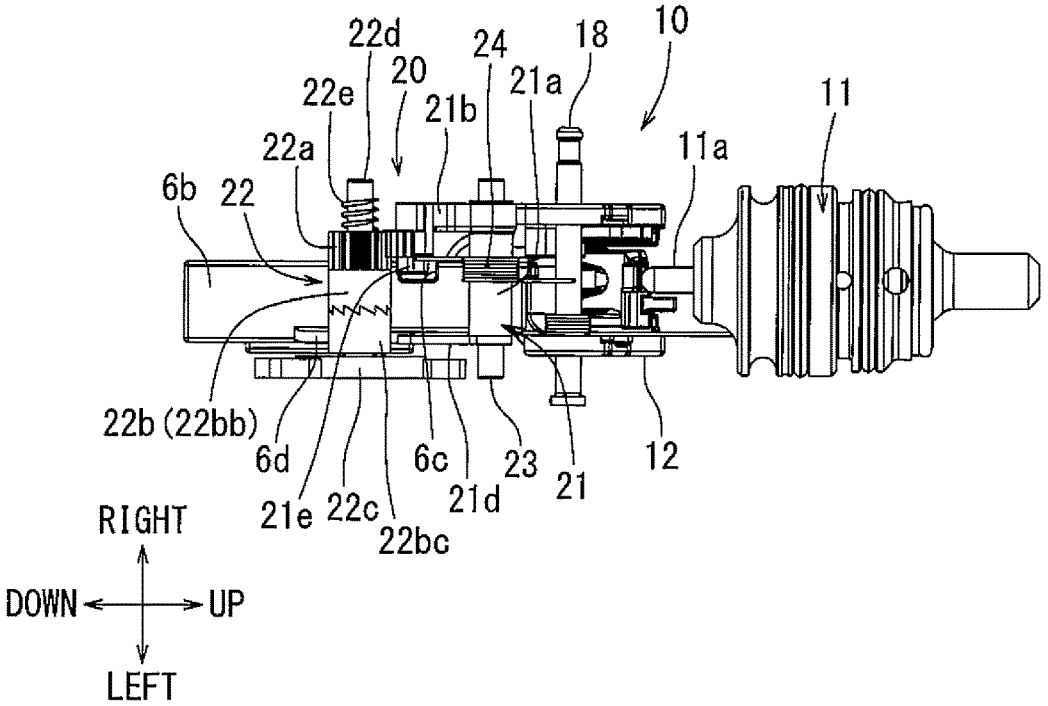
FIG. 7 is a top view of the starting device according to the first embodiment.

The contact restriction member 21 is biased by a torsion spring 24 in a counterclockwise direction in FIG. 6 (e.g., toward a contact lock side). A stopper receiving portion 12*b* is formed on the lower surface of the trigger 12. The stopper receiving portion 12*b* is situated above the stopper 21*c*. When the trigger 12 is positioned downward (e.g., in the off position) as shown in FIG. 6, the stopper 21*c* is pushed downward by the stopper receiving portion 12*b*. Accordingly, the contact restriction member 21 rotates in a clockwise direction, and against the biasing force of the torsion spring 24, to be retained at an initial position. When the contact restriction member 21 is positioned at the initial position, the release arm 21*d* is moved to the front side, with respect to the extension portion 6*b*, of the contact arm 6 (on the top side of the drawing in FIG. 6).

Figure 5:
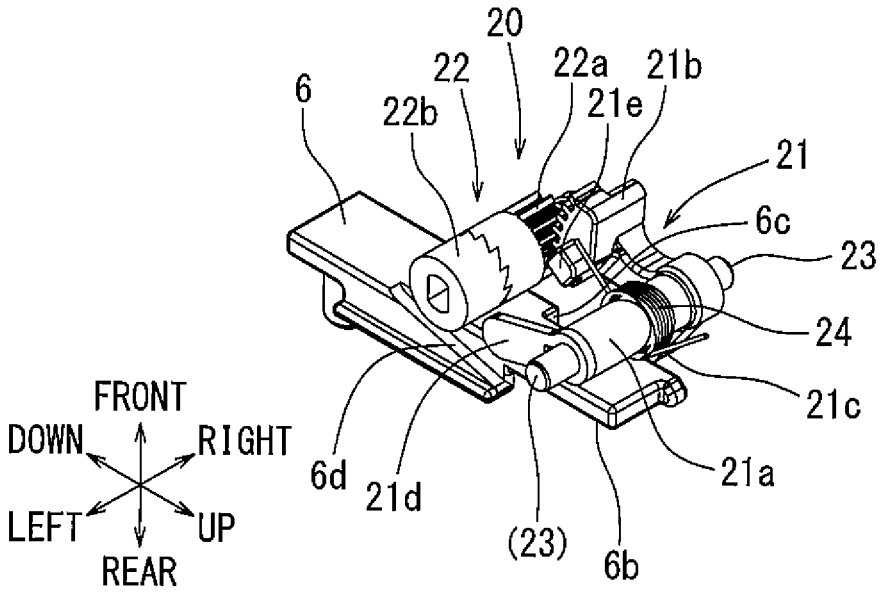
FIG. 5 is a perspective view of components of the starting device according to the first embodiment. This figure differs from FIG. 4 in that the embodiment of a trigger and a rotation damper are removed.

The extension portion 6*b* of the contact arm 6 includes a lock receiving portion 6*c* and a release guide portion 6*d*. As shown in FIG. 5, the lock receiving portion 6*c* is formed to be cut out in a concave shape on the right side of the extension portion 6*b*. The release guide portion 6*d* is formed on the left side of the extension portion 6*b*. The release guide portion 6*d* has a surface that is tilted in the thickness direction of the extension portion 6*b*. In other words, the surface is tilted in a direction approaching the front side when viewed from the up-to-down viewing direction.

In a state where the contact arm 6 is not on-operated and where the contact restriction member 21 is rotated to the lock side (in the counterclockwise direction in FIG. 6) such that the lock portion 21*e* enters the lock receiving portion 6*c* of the contact arm 6, the on-operation of the contact arm 6 is prevented.

In contrast, when the contact arm 6 is on-operated before the contact restriction member 21 is moved to the lock position (e.g., in a position where the lock portion 21*e* enters the lock receiving portion 6*c*), the rotation tip end of the release arm portion 21*d* contacts the release guide portion 6*d*. Under this contacted state of the release arm portion 21*d*, when the contact arm 6 is on-operated (e.g., moves upward), the release arm portion 21*d* is pushed in the forward direction along the tilted surface of the release guide portion 6*d*. This causes the contact restriction member 21 to be returned to its initial position. Accordingly, the contact arm 6 is allowed to move to the on-position (e.g., on-operated).

The timer setting portion 22 is arranged downward of the contact restriction member 21. The timer setting portion 22 includes an intermediate gear 22*a* that engages with the gear arm 21*b* of the contact restriction member 21, a one-way clutch 22*b*, and a rotation resistance applying member 22*c*. The rotation resistance applying member 22*c* is a so-called rotary damper, in which a predetermined rotational resistance, in both directions, is applied to its operation shaft 22*d* by the inserted silicon oil. The intermediate gear 22*a* and the one-way clutch 22*b* are supported on the operation shaft 22*d* of the rotation resistance applying member 22*c*. The operation shaft 22*d* can be seen in FIG. 7. A driven-side 22*bc* of the one-way clutch 22*b* is fixed both in the axial direction and in the rotational direction with respect to the operation shaft 22*d*.

The intermediate gear 22*a* is formed integral with a driving-side 22*bb* of the one-way clutch 22*b*. The driving-side 22*bb* of the one-way clutch 22*b* and the intermediate gear 22*a* are displaceable in the axial direction and are moved together in the rotational direction (spline engagement). The driving-side 22*bb* of the one-way clutch 22*b* and the intermediate gear 22*a* are biased by a compression spring 22*e* in the leftward direction in which the driving side 22*bb* engages with the driven-side 22*ba* (in the bottom direction of the drawing in FIG. 7). A rotation movement of the gear arm 21*b* of the contact restriction member 21 is transmitted to the operation shaft 22*d* of the rotation resistance applying member 22*c* via the intermediate gear 22*a* and the one-way clutch 22*b*.

A torque transmission direction of the one-way clutch 22*b* is configured such that a rotational torque generated when the gear arm 21*b* is moved rearward is transmitted from the driving-side 22*bb* to the driven-side 22*ba*. In contrast, a rotational torque generated when the gear arm 21*b* is moved forward is not transmitted because the driving side 22*bb* is relatively rotated with respect to the driven-side 22*ba*. Because of this configuration, when the timer is operated, e.g., when the gear arm 21*b* rotates to the lock position side (e.g., in the counterclockwise direction in FIG. 6), a predetermined rotational resistance is generated by the rotation resistance applying member 22*c*. In contrast, when the timer is released, e.g., when the gear arm 21*b* rotates to the unlock position side (e.g., in the clockwise direction in FIG. 6), the above-described rotational resistance is not generated because the gear arm 21*b* is disengaged with the rotation resistance applying member 22*c*.

After the trigger 12 is on-operated, the predetermined rotation resistance is applied to the contact restriction member 21 by the rotation resistance applying member 22*c* of the timer setting portion 22. Because of this configuration, a predetermined time period (e.g., reference time t) is required for the lock portion 21*e* to enter the lock receiving portion 6*c* in order to block the on-operation of the contact arm 6. The timer mechanism 20 that is configured as described above is positioned between the trigger 12 and the extension portion 6*b* of the contact arm 6. Thus, an inadvertent driving operation can be prevented while the trigger 12 is on-operated.

When both the trigger 12 and the contact arm 6 are on-operated, the valve stem 11*a* is pushed upward by the idler 19 to turn on the starting valve 11. As described above, when the starting valve 11 is tuned on, compressed air is supplied to the piston upper chamber 16 to perform the driving operation. For example, in a driving operation (such as the continuous driving operation) in which the contact arm 6 is on-operated while the trigger 12 is being on-operated, the on-operation of the contact arm 6 is prohibited after the reference time t, set by the timer mechanism 20, has passed. The prohibition state of the on-operation of the contact arm 6 can be removed by releasing the on-operation of the trigger 12. As another example, in a driving operation (such as the single driving operation) in which the trigger is on-operated while the contact arm is being on-operated, the prohibition state caused by the timer mechanism 20 is not generated. In the following, operation conditions of the timer mechanism 20 relating to each operation mode will be explained.

Figure 8:
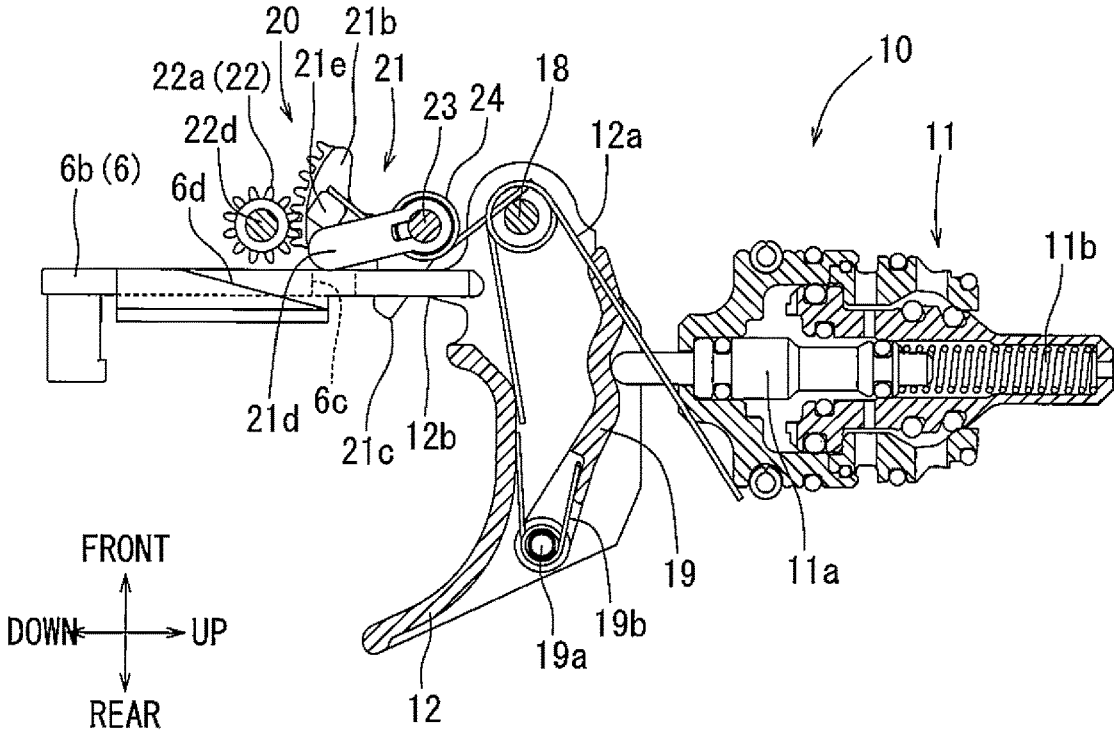
FIG. 8 is a longitudinal sectional view of the starting device according to the first embodiment. This figure shows an initial state.
Figure 9:
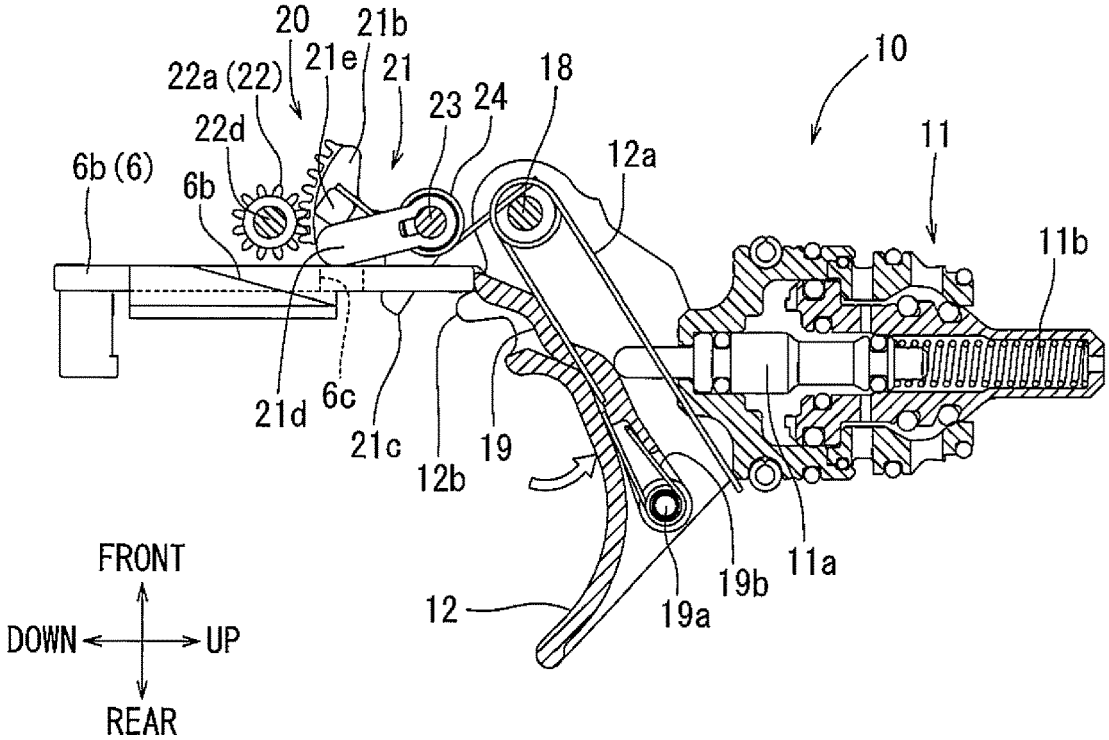
FIG. 9 is a longitudinal sectional view of the starting device according to the first embodiment. This figure shows a state in which the trigger is on-operated after the initial state shown in FIG. 8.
Figure 10:
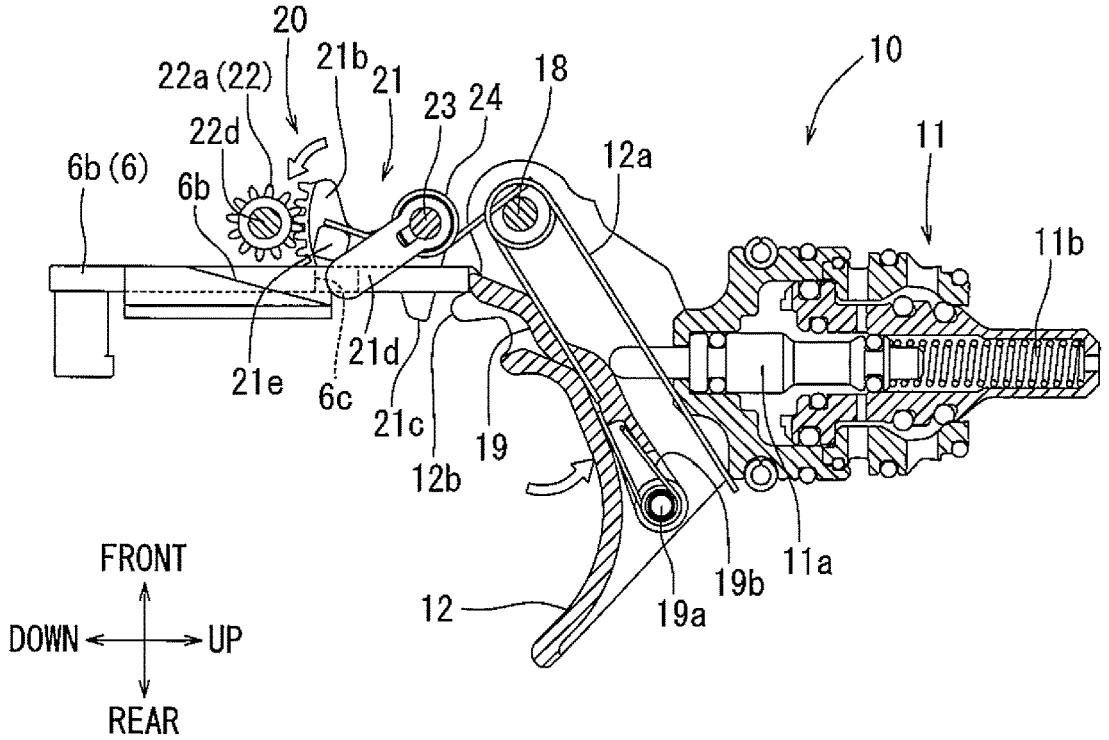
FIG. 10 is a longitudinal sectional view of the starting device according to the first embodiment. This figure shows a state in which a timer has been activated.

In order to perform the continuous driving operation mode, the trigger 12 is pulled upward as shown in FIG. 9, from the initial position shown in FIG. 8, such that the timer mechanism 20 is activated. When the trigger 12 is pulled upward, the stopper 21*c* is no longer prohibited from moving upward. As a result, the stopper 21*c* enters a state to be able to move upward. When the stopper 21*c* enters a state in which it is able to move upward, the contact restriction member 21 starts to rotate toward the lock side (e.g., in the counterclockwise direction in FIG. 10) by the force of the torsion spring 24. When the contact restriction member 21 turns toward the lock side, the release arm portion 21*d* and the lock portion 21*e* move rearward.

Figure 11:
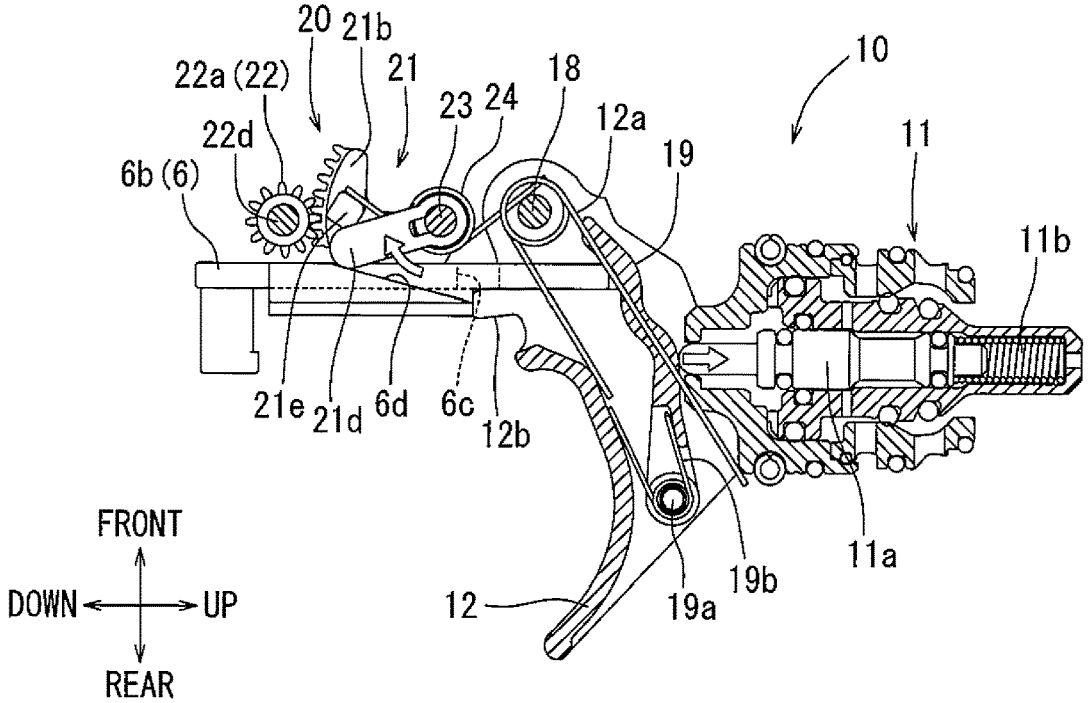
Figure 12:
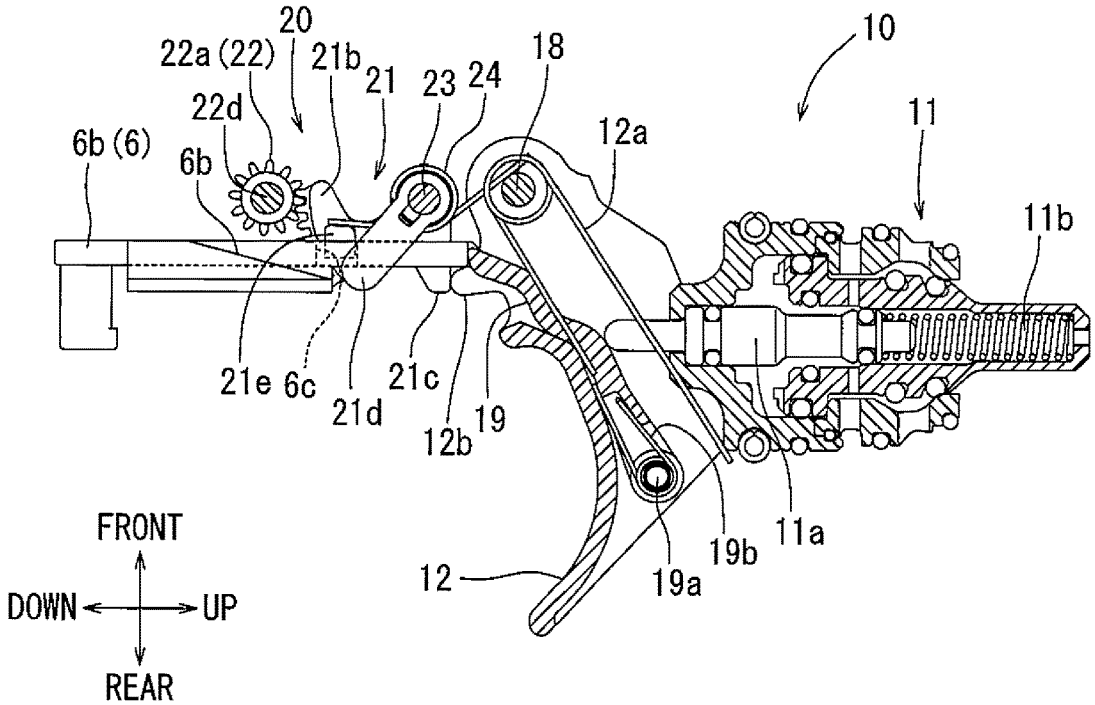
FIG. 12 is a longitudinal sectional view of the starting device according to the first embodiment. This figure shows a contact lock state in which the predetermined time of the timer has passed and the contact arm is restricted from being on-operated.

As shown in FIG. 12, a rotation end position of the contact restriction member 21 toward the lock side is restricted from further movement by the stopper 21*c* contacting the stopper receiving portion 12*b* of the trigger 12, which has been moved to its on-position. While the contact restriction member 21 is rotating to the lock side, the predetermined rotation resistance is applied to the contact restriction member 21 by the timer setting portion 22. The reference time t corresponds to the time it takes the contact restriction member 21 to reach the rotation end position at the lock side, as shown in FIG. 12. FIG. 11 shows that the contact arm 6 is on-operated before the reference time t has passed.

When the contact arm 6 is on-operated before the reference time t has passed, the release arm portion 21*d* of the contact restriction member 21 contacts the release guide portion 6*d*, as shown in FIG. 11. The release arm portion 21*d* is pushed forward along the tilted surface of the release guide portion 6*d*, moving the top end of the contact arm upward. As a result, the contact restriction member 21*d* rotates in the clockwise direction (e.g., the unlock side) as shown by a void arrow in FIG. 11. Therefore, the contact restriction member 21*d* returns to its initial position. While the contact restriction member 21 is being rotated to the unlock side, a rotational resistance is not applied to the contact restriction member 21. This is partly because the rotation resistance applying member 22*c* is released, owing to the one-way clutch 22*d* in the timer setting portion 22. Accordingly, the contact restriction member 21 can be rapidly returned to the unlock side (e.g., to the initial position side). Because the contact restriction member 21 is returned to the unlock side, the contact arm 6 is not prohibited from moving to the on-position. As shown in FIG. 11, when the contact arm 6 is on-operated before the reference time t has passed while the trigger 12 is being on-operated, the idler 19 is pushed to a predetermined on-position by the extension portion 6*d* of the contact arm 6. This turns on the starting valve 11. As a result, a driving operation is performed in the tool main body 2.

When the contact arm 6 is not on-operated before the reference time t has passed while the trigger 12 is being on-operated, the lock portion 21*e* of the contact restriction member 21 enters the lock receiving portion 6*c*, as shown in FIG. 12. When the lock portion 21*e* enters the lock receiving portion 6*c*, the contact arm 6 is restricted from moving further upward. As a result, the idler 19 cannot be pushed to the on-position and thus the starting valve 11 is not turned on. Accordingly, the driving operation is not performed.

As discussed above, in the continuous driving operation mode, in which the trigger 12 is being on-operated before on-operating the contact arm 6, the on-operation of the contact arm 6 is prohibited after the reference time t has passed. Because of this configuration, when the driving tool 1 is carried with the trigger 12 being pulled, an inadvertent driving operation can be prevented without fail. In the above-exemplified timer mechanism 20, the reference time t is configured to be set by applying the rotation resistance of the contact restriction member 21 using the rotation resistance applying member 22*c*, which is embodied as the rotary damper. In other words, the timer mechanism 20 does not include an operation part that is powered, for example, by compressed air. As a result, the timer mechanism 20 can be operated smoothly.

As discussed above, in the continuous driving operation mode, in which the trigger 12 is on-operated at first, the timer mechanism 20 is activated to prevent the inadvertent driving operation in the tool main body 2. In the driving tool 1 according to the present embodiment, when the contact arm 6 is on-operated at first, the driving operation can also be performed. In the single driving operation mode, in which the contact arm 6 is being on-operated before on-operating the trigger 12, the timer mechanism 20 is not activated. In the single driving operation mode, a user on-operates the contact arm 6 at first and subsequently on-operates the trigger 12, which indicates a clear intention of driving. Thus, in the single driving operation mode, there is a low probability that an inadvertent driving of the tool main body 2 would occur.

In the single driving operation mode, the contact arm 6 is on-operated, after the initial position shown in FIG. 8. Because the trigger 12 has not yet been on-operated, the stopper receiving portion 12*b* of the trigger 12 continues to push the stopper 21*c* (not shown in FIG. 13) downward and accordingly the initial position of the contact restriction member 21 is maintained. Because of this configuration, the release arm portion 21*d* is offset in the forward direction from a moving path of the extension portion 6*b* of the contact arm 6. Also, the lock portion 21*e* is largely offset in the forward direction with respect to the lock receiving portion 6*c*. Because the movement of the extension portion 6*b* of the contact arm 6 is not restricted by the contact restriction member 21, the extension portion 6*b* of the contact arm 6 can be moved to contact a lower surface of the idler 19.

Figure 13:
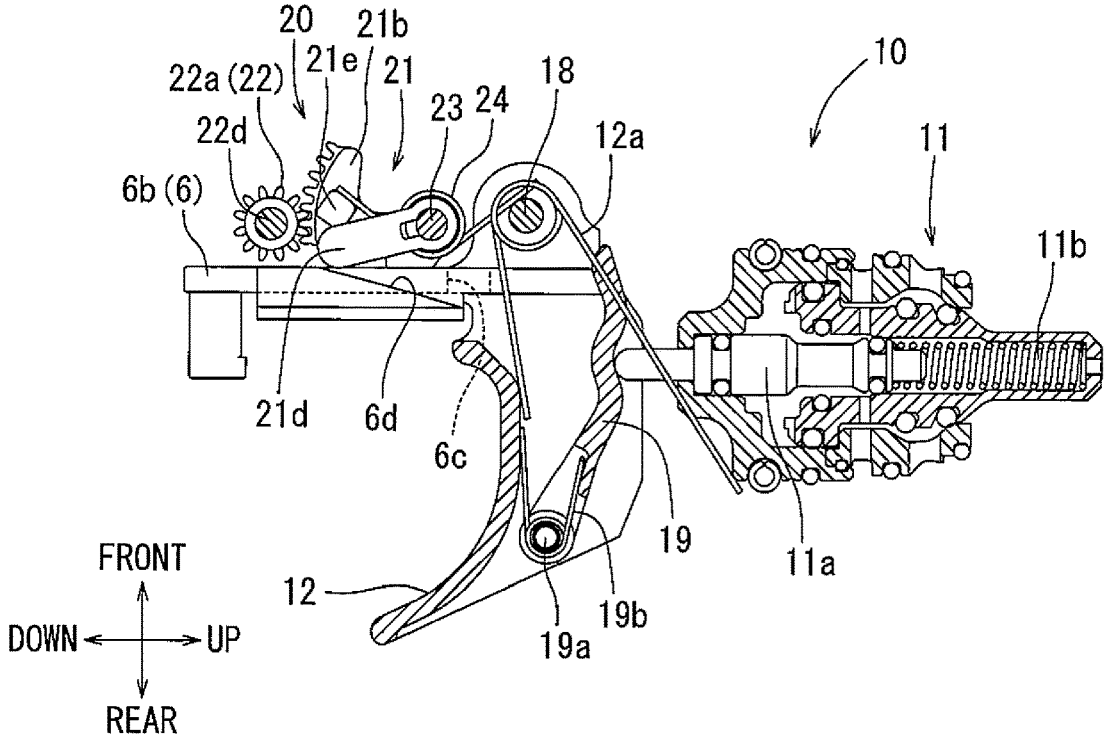
FIG. 13 is a longitudinal sectional view of the starting device according to the first embodiment. This figure shows a state in which the contact arm is on-operated at first after the initial state shown in FIG. 8.
Figure 14:
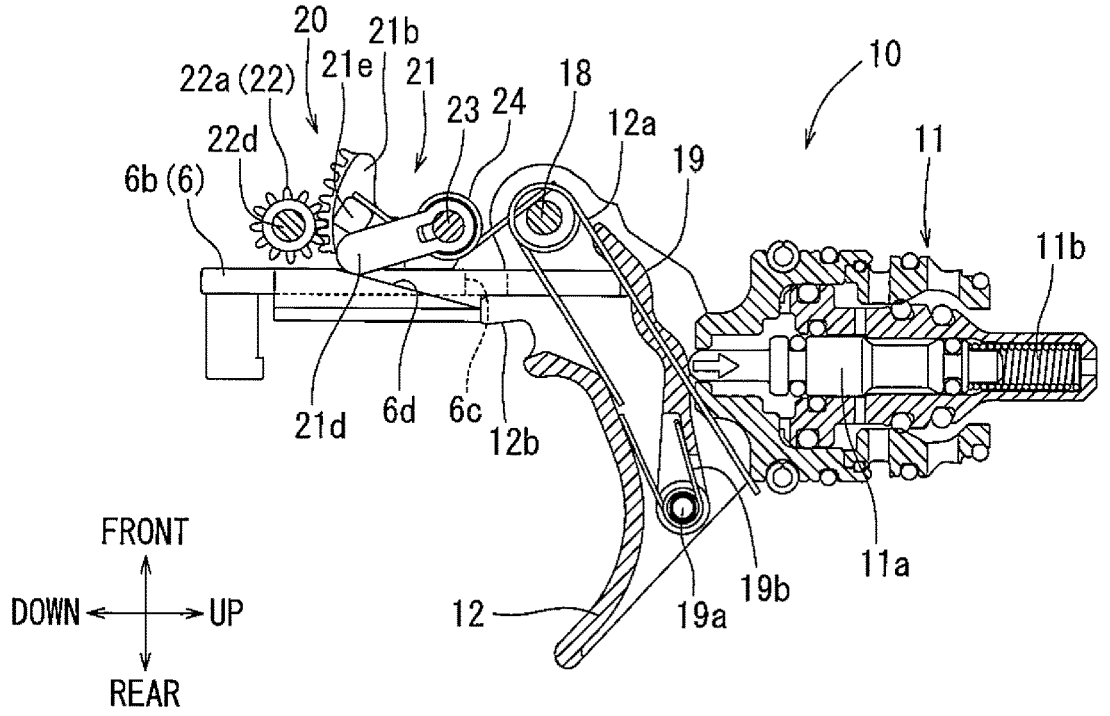
FIG. 14 is a longitudinal sectional view of the starting device according to the first embodiment. This figure shows a state in which the trigger is further on-operated after the on-operation of the contact arm shown in FIG. 13 and the starting valve is turned on. In this state, the timer is not activated.

When the trigger 12 is subsequently on-operated, as shown in FIG. 14, while the contact arm 6 is on-operated as shown in FIG. 13, the valve stem 11*a* is pushed upward to turn on the starting valve 11. Turning on the starting valve 11 performs the driving operation of the tool main body 2. In the single driving operation mode, after one driving operation is performed, the trigger 12 may be returned to the off-position and the contact arm 6 may also be returned to the off-position, so that the driving tool 1 is returned to its initial state.

Figure 15:
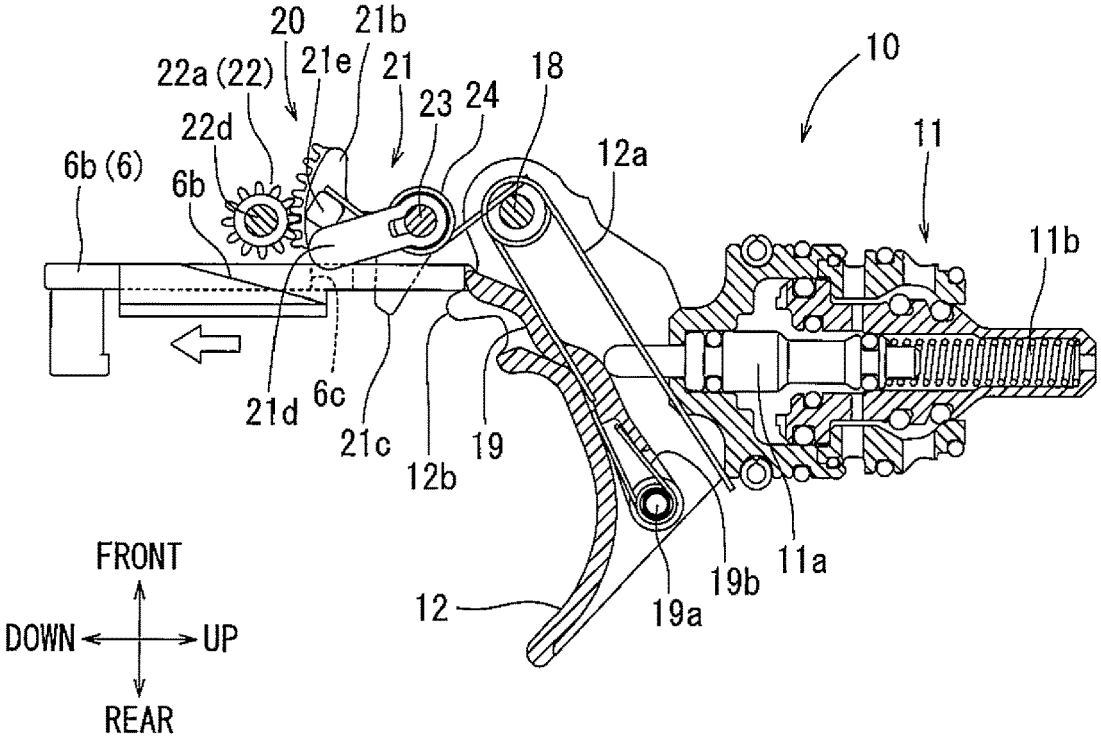
FIG. 15 is a longitudinal sectional view of the starting device according to the first embodiment. This figure shows a state in which the contact arm is returned to an off-position after the on-state of the starting valve (a state of a driving operation) shown in FIG. 14. This figure also shows a state in which the timer starts to be activated.
Figure 16:
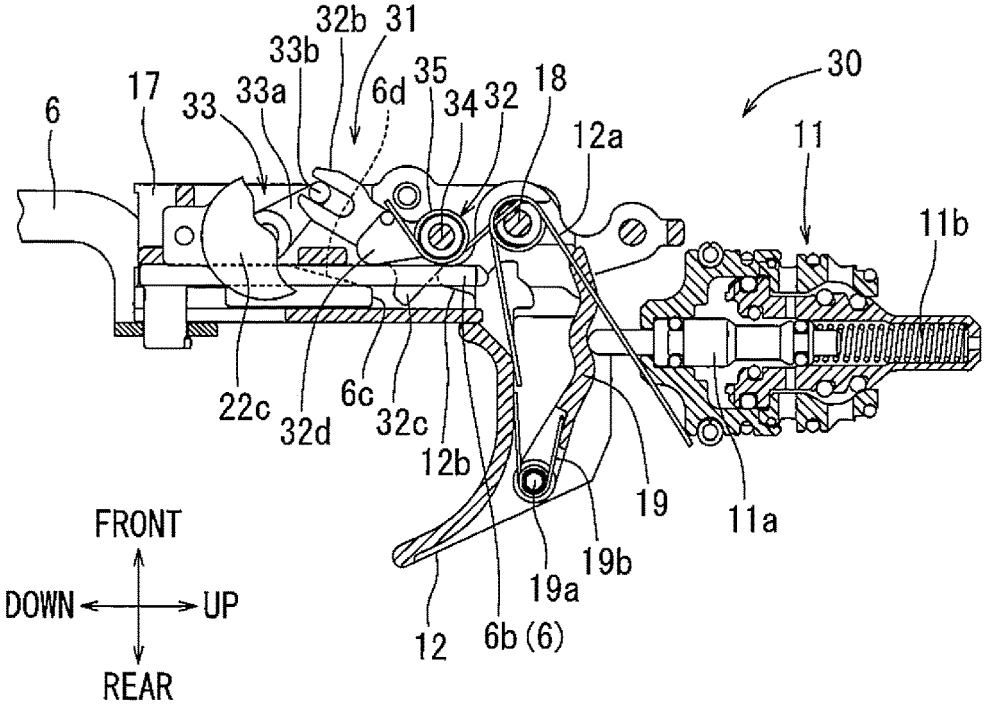
FIG. 16 is a longitudinal sectional view of the starting device according to a second embodiment.
Figure 17:
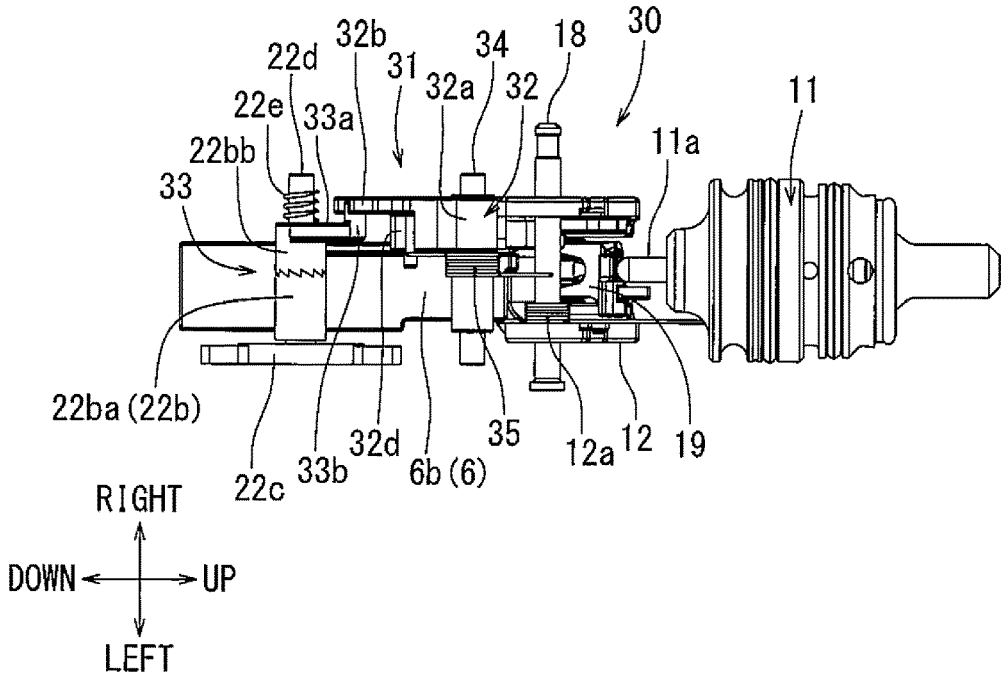
FIG. 17 is a top view of the starting device according to the second embodiment. In this figure, the starting base is removed.

In the single driving operation mode, when only the on-operation of the contact arm 6 is released with the trigger 12 still being on-operated after a driving operation is performed, for example as shown in FIG. 15, the operation mode of the driving tool 1 is effectively placed in the continuous driving operation mode. Essentially, the state shown in FIG. 15 results in the same state as FIG. 9, in which the trigger 12 is on-operated and the contact arm 6 has not yet been on-operated while driving tool 1 is in the continuous driving mode. In these states, when the contact arm 6 is off-operated while the trigger is being on-operated, the extension portion 6*b* of the contact arm 6 retracts from the rear of the release arm portion 21*d*, thereby allowing the contact restriction member 21 to rotate to the lock side. Furthermore, because the trigger 12 is retained in the on-operation state, the stopper receiving portion 12*b* is spaced apart from the stopper 21*c*, in the upward direction. Because of this configuration, in the single driving operation mode, when the contact arm 6 is returned to the off-position after the first driving operation is performed, the timer mechanism 20 is activated. In more detail, the contact restriction member 21 starts to rotate to the lock side, similar to the continuous driving operation mode. Because of this configuration, even after beginning in the single driving operation mode, the continuous driving operation can be continuously performed by on-operating the contact arm 6 before each reference time t has passed. Additionally, after the reference time t has passed, the on-operation of the contact arm 6 is prohibited, thereby preventing an inadvertent driving operation.

The driving operation prohibition state (e.g., the on-operation prohibition state of the contact arm 6) caused by the timer mechanism 20 can be reset once the on-operation of the trigger 12 is released. When the trigger 12 is returned to the off-position, the stopper receiving portion 12*b* pushes the stopper 21*c* against the biasing force of the torsion spring 24, in the downward direction, to return the contact restriction member 21 to its initial position. As a result, the starting device 10 is reset to the initial state, which is shown in FIG. 8.

According to the starting device 10 of the first embodiment configured as discussed above, when the trigger 12 is on-operated while the contact arm 6 is not on-operated, the timer mechanism 20 is activated. Because of this configuration, for example, when the driving tool 1 is carried with the trigger 12, an inadvertent driving operation in the tool main body 2 can be prevented after the reference time t has passed, even if the contact arm 6 is mistakenly touched to another member.

Furthermore, the starting device 10 according to the first embodiment is provided with the timer mechanism 20 that works solely in a mechanical manner. It can work without an electric controller that needs electric power. As a result, the starting device 10 can still work in an environment where electric power cannot be supplied.

Furthermore, the above-exemplified timer mechanism 20 does not include a part that needs to be activated by compressed air. Except the rotational resistance caused by the rotation resistance applying member 22*c*, smooth movement (e.g., reactivity) can be obtained in each members of the timer mechanism 20. As a result, operability (e.g., quick driving) of the driving tool 1 can be improved.

Variations and modifications may be effected without departing from the spirit and scope of the present teachings. For example, FIGS. 16-26 show a starting device 30 that is provided with a timer mechanism 31 according to a second embodiment. The timer mechanism 31 of the second embodiment differs from the timer mechanism 20 of the first embodiment in that the contact restriction member 32 is not linked to the timer setting portion 33 via the gear mechanism, but instead via a link mechanism. Descriptions of the members and configurations that do not need to be modified and are in common between the first and second embodiments are omitted and are referred to using of the same reference numerals.

The timer mechanism 31 according to the second embodiment is provided with a contact restriction member 32 that is supported by the starting base 17 and located below the trigger 12 and a timer setting portion 33 that is supported by the starting base 17 and located below the contact restriction member 32. The contact restriction member 32 is supported so as to be rotatable in the front-to-rear direction via a support shaft 34. The contact restriction member 32 is biased by a torsion spring 35 in the counterclockwise direction (e.g., the contact lock side) in FIG. 16. The contact restriction member 32 is configured to include a link arm 32*b*, a stopper 32*c*, and a lock arm 32*d*. These components are formed on a support tubular portion 32*a*, the support tubular portion 32*a* being formed in a tubular shape and being supported by the support shaft 34. In the second embodiment, the lock arm 32*d*, link arm 32*b*, and the stopper 32*c* are arranged on the right end side of the support tubular portion 32*a*. Because of this configuration for the second embodiment, the release guide portion 6*d* is formed along the right end of the extension portion 6*b* of the contact arm 6. The lock receiving portion 6*c* is formed on the upper end of the release guide portion 6*d*.

The lock arm 32*d* is positioned in front of the lock receiving portion 6*c* and the release guide portion 6*d*. When the contact restriction member 32 rotates to the lock side, the lock arm 32*d* integrally rotates in a direction to displace its rotation tip end toward the rearward direction. Furthermore, when the rotation tip end of the lock arm 32*d* enters the upper portion of the lock receiving portion 6*c*, the movement of the contact arm 6 toward the on-position is prohibited by the lock arm 32*d* (e.g., contact arm lock state). In contrast, when the lock receiving portion 6*c* of the contact arm 6 passes the rear of the lock arm 32*d* in advance of the lock arm 32*d* entering the lock receiving portion 6*c*, and instead the rotation tip end of the lock arm 32*d* contacting the upper surface of the release guide portion 6*d*, the lock arm 32*d* is pushed in the forward direction by the tilted surface of the release guide portion 6*d*, so as to return its initial position. This allows the contact arm 6 to move to the on-position. In this respect, the configuration in the second embodiment is similar to the first embodiment.

The timer setting portion 33 is positioned below the contact restriction member 32. The timer setting portion 33 of the second embodiment is similarly configured as the timer setting portion 22 of the first embodiment, except that the timer setting portion 33 includes an intermediate arm 33*a* instead of an intermediate gear 22*a*. For the descriptions of the members and configurations in common with the first embodiment, the same reference numerals are used in the second embodiment. The intermediate arm 33*a* is formed integral with the driven-side 22*bb* of the one-way clutch 22*b*. The intermediate arm 33*a* is linked to the link arm 32*b* via a link shaft 33*b* formed at the tip end of the intermediate arm 33*a*. The intermediate arm 33*a* is linked to the link arm 32*b* so that they may rotate in opposite directions. The rotational resistance of the rotation resistance applying member 22*c* is transferred to the contact restriction member 32 during rotation thereof, via the one-way clutch 22*b* and the link between the intermediate arm 33*a* and the link arm 32*b*.

After the trigger 12 is on-operated, a predetermined rotation resistance is applied to the contact restriction member 32 by the rotation resistance applying member 22*c* of the timer setting portion 33. Because of this configuration, a required time until the lock arm 32*d* enters the upper of the lock receiving portion 6*c*, and accordingly the time until the on-operation of the contact arm 6 is blocked, can be set. Because the contact restriction member 32, as configured above, is positioned between the trigger 12 and the extension portion 6*b* of the contact arm 6, an inadvertent driving operation can be prevented while the trigger 12 is being on-operated.

Figure 18:
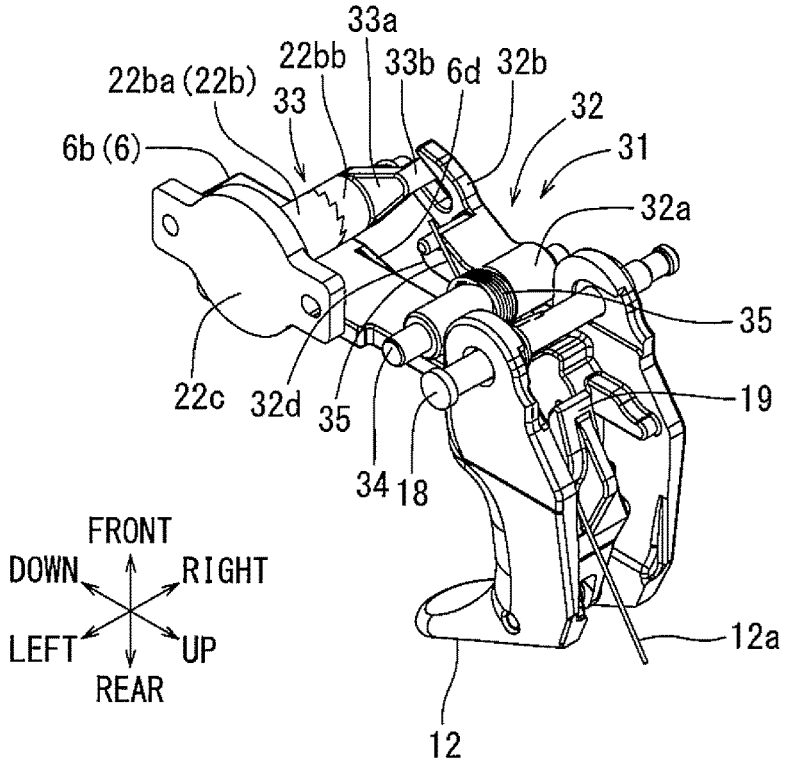
FIG. 18 is a perspective view of the starting device according to the second embodiment. In this figure, the starting base and the starting valve are removed.

The starting device 30 comprising the timer mechanism 31 according to the second embodiment may essentially function in approximately the same way as the starting device 10 comprising the timer mechanism 20 according to the first embodiment. A brief explanation will followed. FIG. 18 shows an initial state of the starting device 30 comprising the timer mechanism 31 of the second embodiment. In FIGS. 19-26, the rotation resistance applying member 22*c* of the timer setting portion 33 and the one-way clutch 22*b* are omitted. Furthermore, the starting base 17 is omitted and only the extension portion 6*b* of the contact arm 6 is illustrated.

Figure 19:
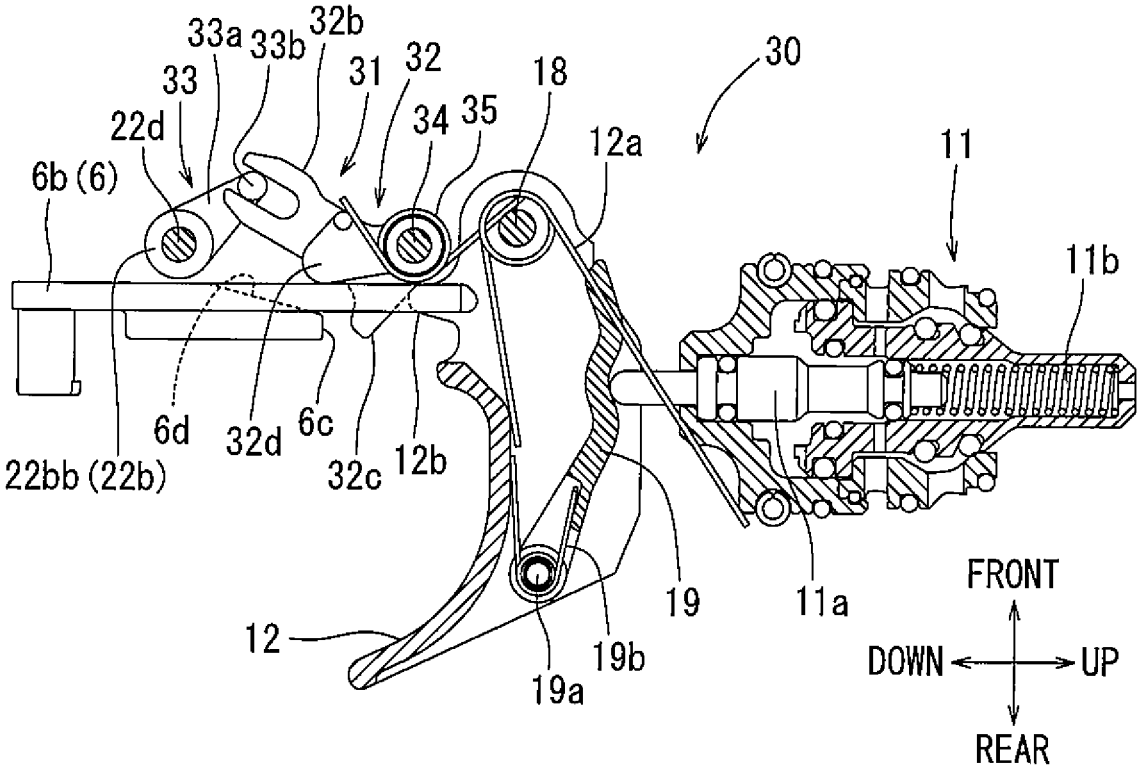
FIG. 19 is a longitudinal sectional view of the starting device according to the second embodiment. This figure shows an initial state.
Figure 20:
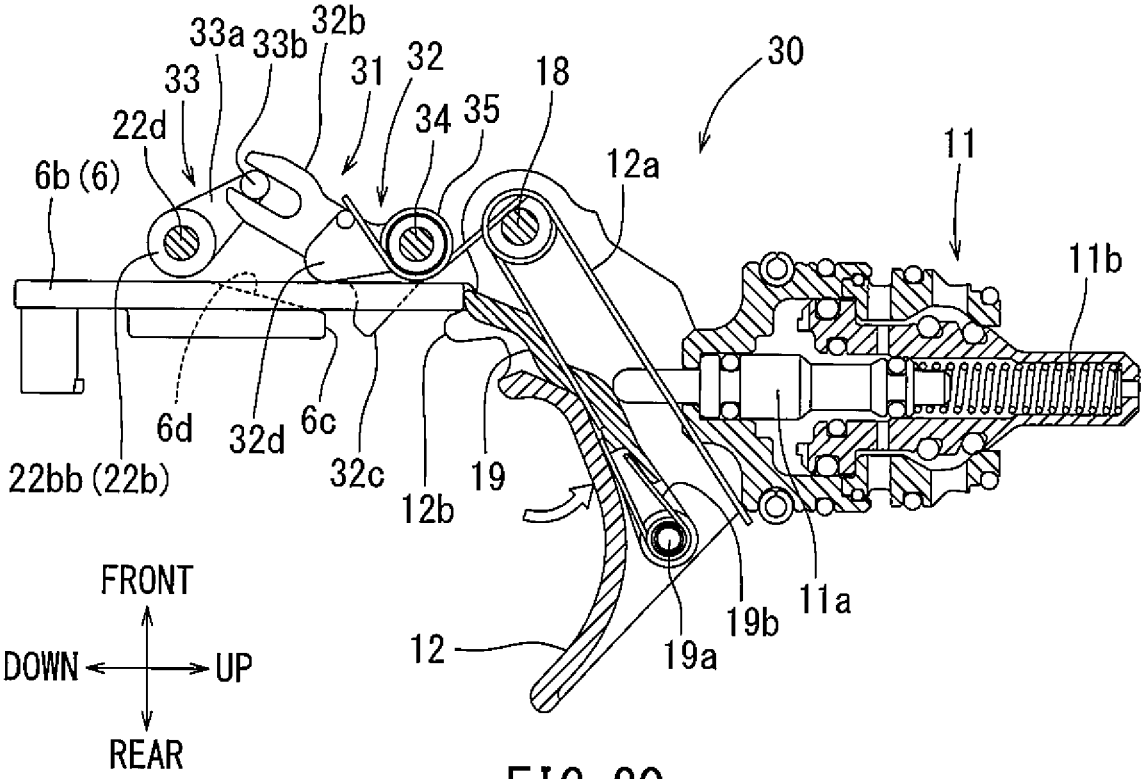
FIG. 20 is a longitudinal sectional view of the starting device according to the second embodiment. This figure shows a state in which the trigger is on-operated after the initial state shown in FIG. 19.
Figure 21:
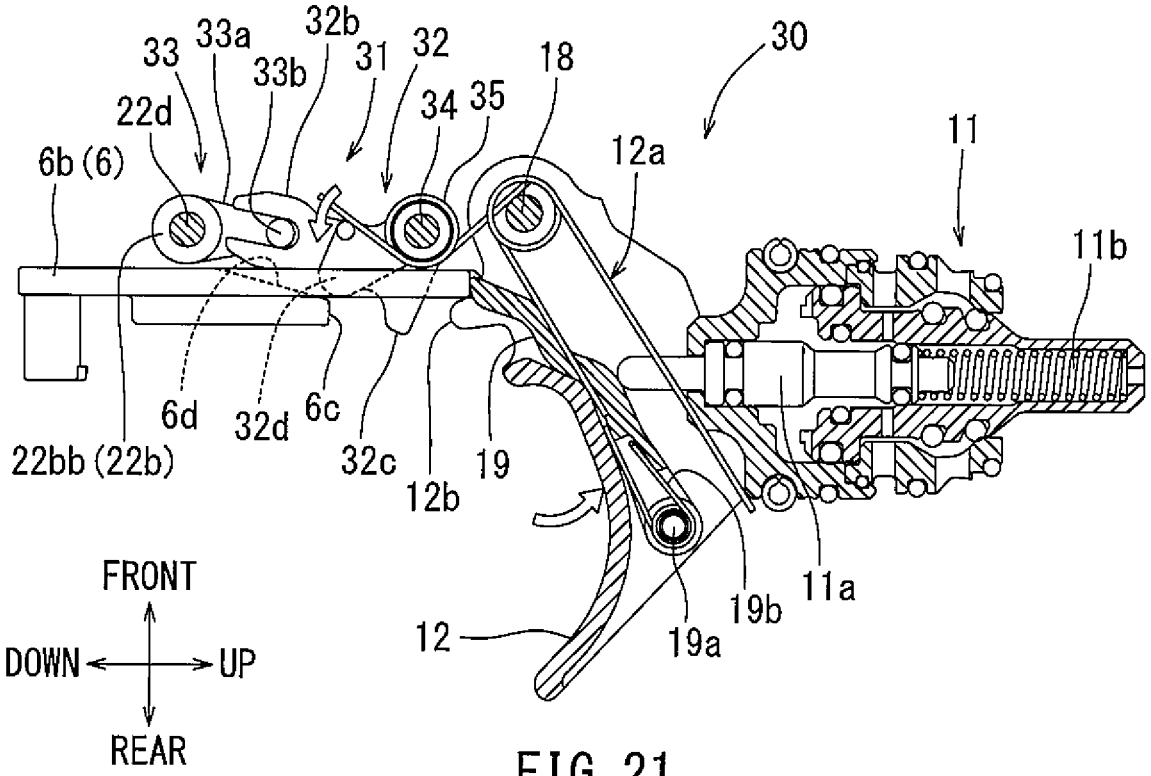
FIG. 21 is a longitudinal sectional view of the starting device according to the second embodiment. This figure shows a state in which the timer has been activated.

When the trigger 12 is on-operated after the initial state shown in FIG. 19, the stopper receiving portion 12*b* of the trigger 12 is moved upward as shown in FIG. 20. The contact restriction member 32 enters a state able to be rotated to the lock side. Accordingly, the timer mechanism 31 is activated. When the timer mechanism 31 is activated as shown in FIG. 21, the contact restriction member 32 rotates to the lock side (e.g., in the counterclockwise direction of FIG. 21). While the contact restriction member 32 rotates to the lock side, the rotation resistance applying member 22*c* applies a rotational resistance to the contact restriction member 32, via the link of the link arm 32*b* and the intermediate arm portion 33*a*. Because of this configuration, the contact restriction member 32 rotates to the lock side by the biasing force of the torsion spring 35 while the rotational resistance of the rotation resistance applying member 22*c* is being applied to the contact restriction member 32.

Figure 22:
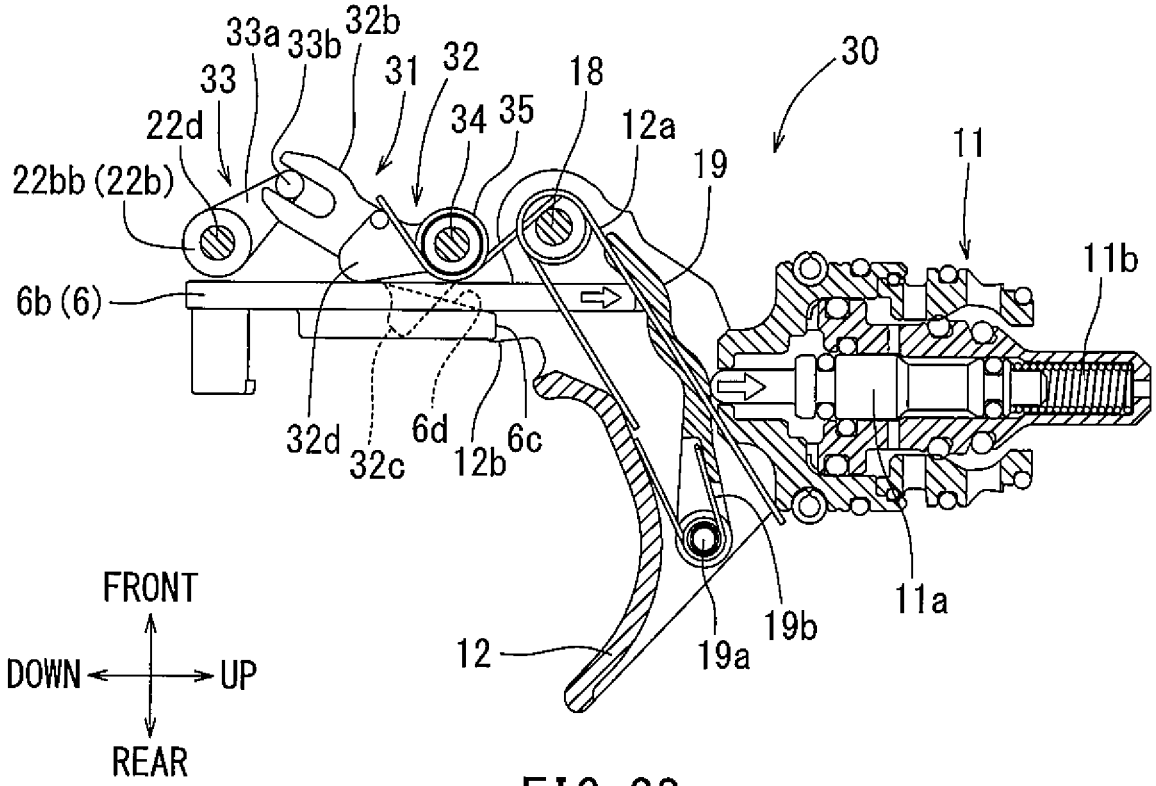

When the contact arm 6 is on-operated before the stopper 21*c* of the contact restriction member 32 reaches the stopper receiving portion 12*b* of the trigger 12 (e.g., before the reference time t has passed), the idler 19 is pushed upward to turn on the starting valve 11, as shown in FIG. 22. Accordingly, the driving operation is performed in the tool main body 2. Because the contact arm 6 is moved in the upward direction while the lock arm 32*d* of the contact restriction member 32 is contacting the release guide surface 6*d* of the contact arm 6, the contact restriction member 32 is returned to the unlock side.

Figure 23:
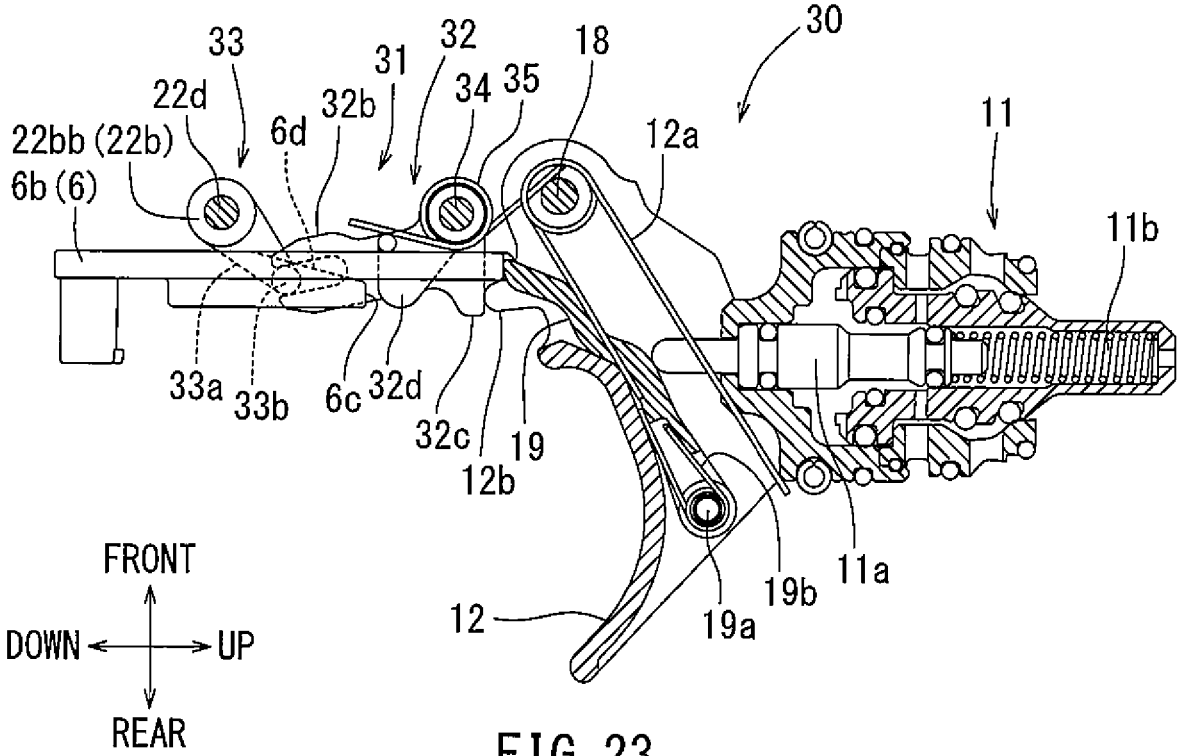
FIG. 23 is a longitudinal sectional view of the starting device according to the second embodiment. This figure shows a contact lock state in which the predetermined time of the timer has passed and the contact arm is restricted from being on-operated.

If the contact arm 6 is not on-operated before the reference time t has passed, the stopper 32*c* contacts the stopper receiving portion 12*b* of the trigger 12 and the contact restriction member 32 reaches the rotation end position on the lock side, as shown in FIG. 23. In this state, the lock arm 32*d* is positioned above the lock receiving portion 6*c*, thereby prohibiting the on-operation of the contact arm 6. In this way, the contact arm 6 can be on-operated to perform the driving operation before the reference time t has passed. In contrast, if the reference time t has passed before the contact arm 6 is on-operated, the on-operation of the contact arm 6 is prohibited and the driving operation accordingly cannot be performed. Because this configuration, for example, when the driving tool 1 is carried with the trigger 12 is being on-operated, an inadvertent driving operation is not performed after the reference time t has passed, even if the contact arm 6 mistakenly contacts other members.

Figure 24:
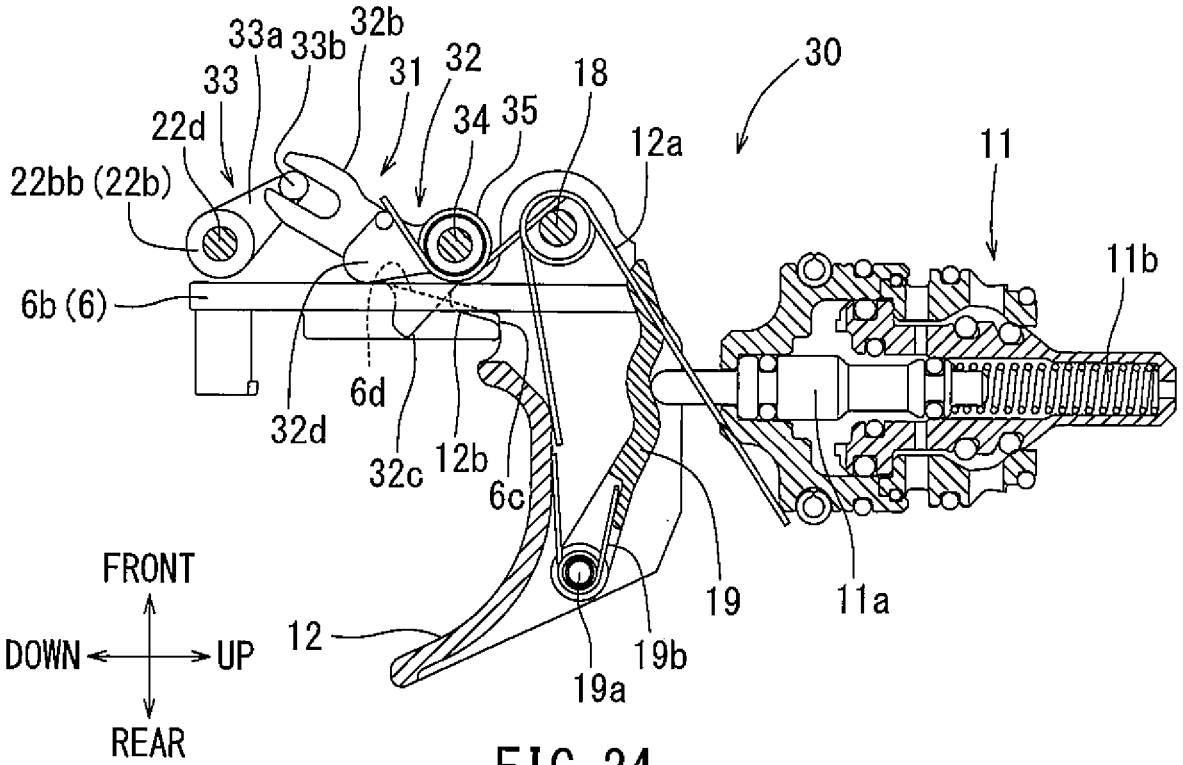
FIG. 24 is a longitudinal sectional view of the starting device according to the second embodiment. This figure shows a state in which the contact arm is on-operated after the initial state shown in FIG. 19.

The lock state of the contact arm 6 caused by the timer mechanism 31 can be released by the off-operation of the trigger, as shown in FIG. 24. When the trigger 12 is returned to the off-position, the stopper receiving portion 12*b* pushes the stopper 32*c* in the downward direction. This, in turn, causes the contact restriction member 32 rotate to the unlock side (e.g., in the clockwise direction in FIG. 23) against the biasing force of the torsion spring 35. Eventually, the contact restriction member 32 is returned to its initial position. When the contact restriction member 32 is returned to the initial position, the lock arm portion 32*d* is retracted from the upper of the lock receiving portion 6*c*. As a result, the contact arm 6 can be moved in the upward direction and be on-operated.

Figure 25:
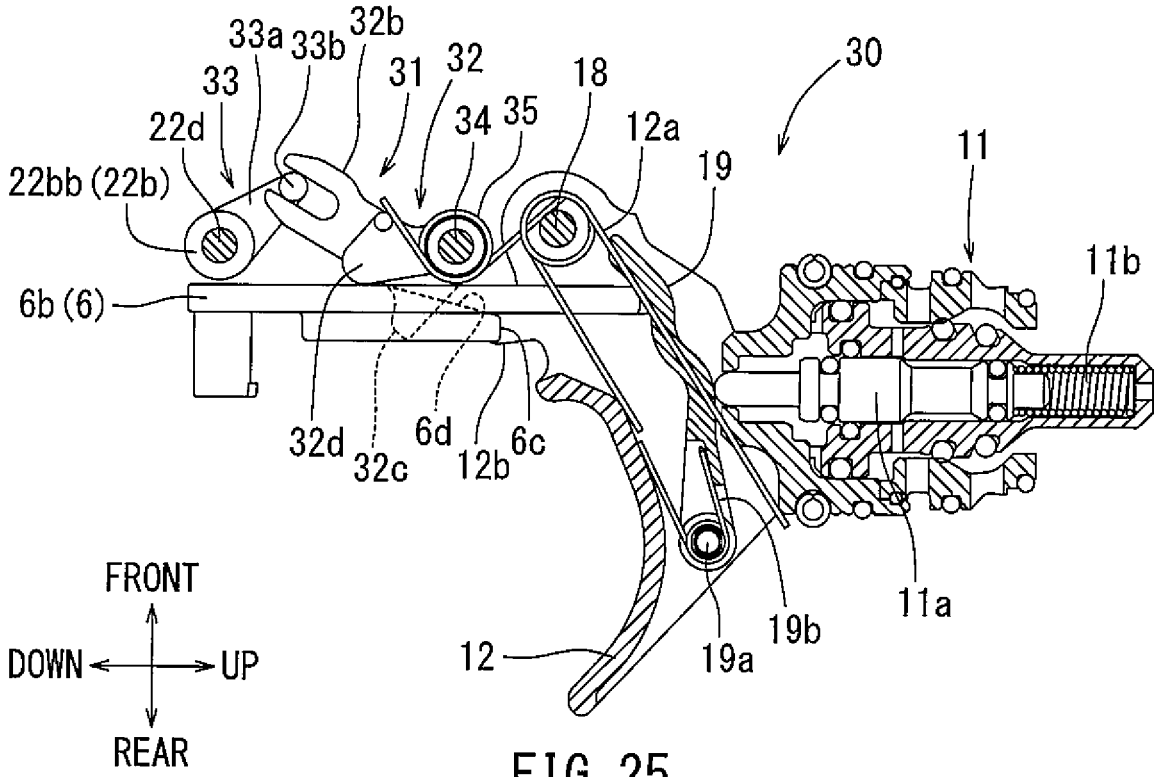
FIG. 25 is a longitudinal sectional view of the starting device according to the second embodiment. This figure shows a state in which the trigger is further on-operated after the on-operation of the contact arm shown in FIG. 24 and the starting valve is turned on. In this state, the timer is not activated.

As shown in FIG. 24, the starting device 30 is in a state such that the contact arm 6 is on-operated before the on-operation of the trigger 12 in order to perform a single driving operation. When the contact arm 6 is on-operated by pushing it against the workpiece W while the trigger 12 is in the off-state, the tip end of the contact arm 6 contacts the lower surface of the idler 19. When the trigger 12 is not on-operated, the stopper receiving portion 12*b* pushes the stopper 32*c* in the downward direction, thereby retaining the contact restriction member 32 in the initial position. In this state, the on-operation of the contact arm 6 is allowed. As shown in FIG. 25, when the trigger 12 is on-operated during the on-operation of the contact arm 6, the idler 19 pushes the valve stem 11*a* in the upward direction, turning on the starting valve 11. As a result, the driving operation is performed in the tool main body 2.

The state in which the contact restriction member 32 is retained at the initial position by the presence of the stopper receiving portion 12*b* is released by the on-operation of the trigger 12. However, in this released state, the lock arm 32*d* is still contacting the extension portion 6*b* of the contact arm 6, thereby restricting the rotation of the contact restriction member 32 to the lock position side (e.g., in the counter-clockwise direction in FIG. 25). As a result, the timer mechanism 31 is not activated.

Figure 26:
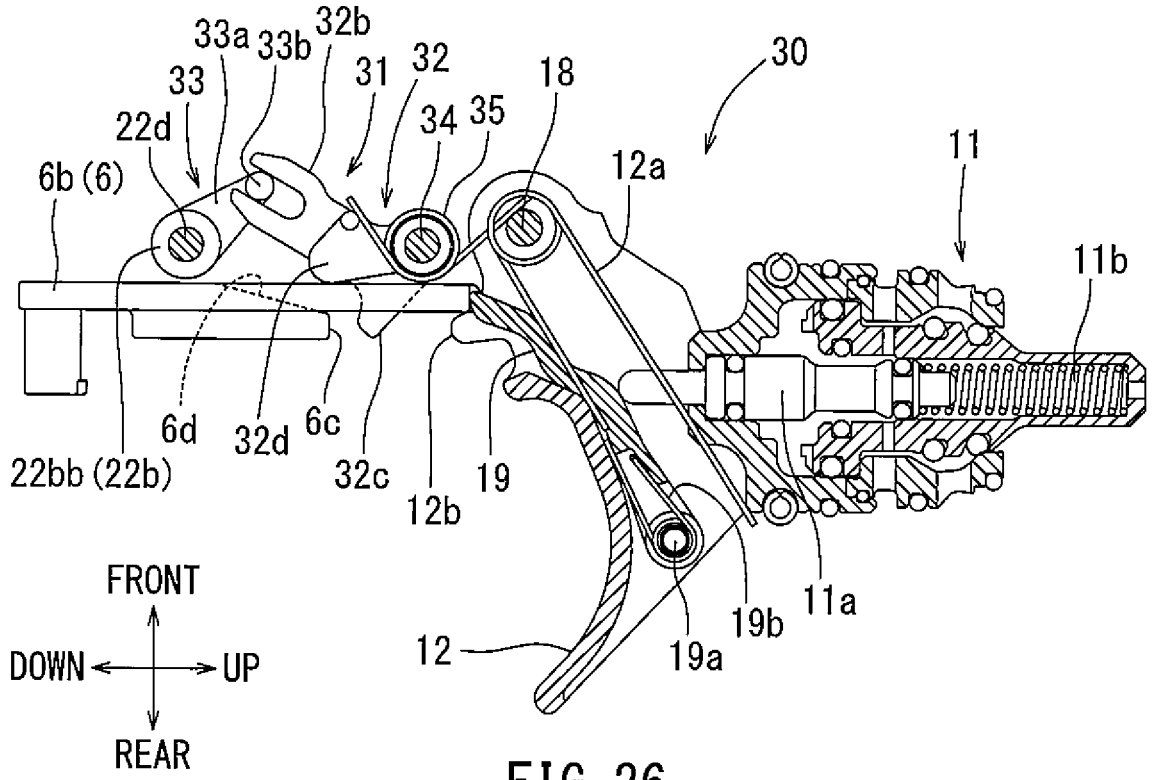
FIG. 26 is a longitudinal sectional view of the starting device according to the second embodiment. This figure shows a state in which the contact arm is returned to an off-position after the on-state of the starting valve (a state of a driving operation) shown in FIG. 25. This figure also shows a state in which the timer starts to be activated.

When the contact arm 6 is subsequently off-operated while the trigger 12 is still being on-operated, as shown in FIG. 26, the timer mechanism 31 is activated. The state shown in FIG. 26 is effectively the same as the state shown in FIG. 20, in which the timer mechanism 21 is activated by the trigger 12 being on-operated before the contact arm 6. Because of this configuration, when the contact arm 6 is off-operated while the trigger 12 is being on-operated, as shown in FIG. 26, and the contact arm 6 is again pushed against the workpiece W before the reference time t is passed, thereby allowing for a continuous driving operation. In contrast, when the contact arm 6 is not on-operated before the reference time t has passed, the on-operation of the contact arm 6 is prohibited by the contact restriction member 32.

In the above configured starting device 30 comprising the timer mechanism 31 according to the second embodiment, when the trigger 12 is on-operated and the contact arm 6 is not on-operated, the timer mechanism 31 is activated. Because of this configuration, for example, when the driving tool 1 is carried with the trigger 12 being on-operated, an inadvertent driving operation can be prevented in the tool main body 2 after the reference time t has passed, even if the contact arm 6 mistakenly contacts other members.

Furthermore, in the timer mechanism 31 according to the second embodiment, the reference time t is set by only a mechanical operation. For instance, the reference time t can be set without the need for an electrical controller that needs electric power. As a result, the timer mechanism 31 can work under an environment where electric power cannot be supplied.

Furthermore, the time mechanism 31 according to the second embodiment does not comprise a part that needs to be activated by compressed air. As a result, apart from the rotation resistance provided by the rotation resistance applying member 22*c*, operation quickness (reactivity) of each portion can be obtained to improve operability (quick driving) of the driving tool 1.

Further modifications can be made to the first and second embodiments discussed above. In the above embodiments, rotational resistance is configured to be directly applied to the contact restriction member 21 by the rotary damper (rotation resistance applying member 22*c*). However, a member serving as the rotational resistance may instead push a rotating member (for example, the support tubular portion 21*a* of the contact restriction member 21) in the lateral direction to apply the rotational resistance to the rotating member.

Furthermore, in the above embodiments, the rotation resistance applying member 22 is configured such that rotational resistance occurs in both rotation directions around the operation shaft 22*d*. However, one-way-type rotation resistance applying member may be used in which rotational resistance occurs only in one direction (e.g., on the contact lock side) and does not occur in the opposite direction, thereby reducing idling. For instance, the one-way clutch 22*b* can be omitted by using the one-way type damper.

Furthermore, in the above embodiments, the one-way clutch 22*b* is used to apply rotational resistance when the contact restriction member 21 moves to the lock side. However, the one-way clutch 22*b* may be omitted and the rotational resistance supplied by the rotation resistance applying member 22*c* may be applied to the contact restriction member 21 in both directions, toward the lock side and the unlock side. Either when rotational resistance is applied in one or both directions, the rotation resistance applying member may be directly linked to the support tubular portion 21*a*, 32*a* of the contact restriction member 21, 32. Accordingly, the gear arm 21*b* or the link arm 32*b*, and the timer setting portion 22 may be omitted. As a result, the timer mechanism 20, 31 may be further simplified.

In the embodiments, a nail gun that can be driven by compressed air is exemplified as the driving tool 1. However, the present teachings can be similarly applied to other types of driving tools, such as an electric tacker comprising a contact arm for preventing incorrect driving operation.

What is claimed is:

1. A driving tool, comprising:

a trigger;

a contact arm; and a mechanical timer mechanism that is configured to be activated when the trigger is on-operated and the contact arm is not on operated, wherein the mechanical timer mechanism includes a contact restriction member configured to selectively restrict a movement of the contact arm to an on-position side.

2. The driving tool according to claim 1, wherein the contact restriction member is configured to prevent the movement of the contact arm to the on-position side after a reference time has passed after the trigger has been on-operated.

3. The driving tool according to claim 2, wherein the contact restriction member moves from an unlock position to a lock position during the reference time.

4. The driving tool according to claim 3, wherein:

the movement of the contact arm to be on-operated is not prevented when the contact restriction member is in the unlock position, and the movement of the contact arm to be on-operated is prevented when the contact restriction member is in the lock position.

5. The driving tool according to claim 1, wherein a movement resistance is applied to the contact restriction member by a resistance applying member.

6. The driving tool according to claim 5, wherein the movement resistance applied to the contact restriction member is less when the contact restriction member moves from a lock position to an unlock position than the applied movement resistance when the contact restriction member moves from the unlock position to the lock position.

7. The driving tool according to claim 1, wherein between an unlock position and a lock position of the contact restriction member, the contact restriction member moves toward an unlock position when the contact arm moves toward the on-position.

8. The driving tool according to claim 1, wherein an on-operation of the contact arm prevents the movement of the contact restriction member toward a lock position.

9. The driving tool according to claim 1, wherein an off-operation of the trigger moves the contact restriction member toward an unlock position.

10. The driving tool according to claim 1, wherein;

the contact restriction member is supported so as to be rotatable between a lock position and an unlock position, and a rotary damper applies rotation resistance to the contact restriction member.

11. The driving tool according to claim 10, wherein a gear engagement or a link mechanism is positioned between the contact restriction member and the rotary damper.

12. A driving tool, comprising:

a trigger;

a mechanical timer mechanism; and a contact arm configured to physically prevent the mechanical timer mechanism from running when the trigger is not on-operated and the contact arm is on-operated.

13. The driving tool according to claim 12, wherein the contact arm is configured to allow the mechanical timer mechanism to run when the contact arm is not on-operated and trigger is on-operated.

14. The driving tool according to claim 13, wherein the contact arm is configured to prevent the mechanical timer mechanism from running in a middle of a path through which the contact arm moves toward an on-position between an off-position and the on-position.

15. A driving tool, comprising:

a trigger;

a mechanical timer mechanism configured to be activated when the trigger is on-operated; and a contact arm configured to prevent the mechanical timer mechanism from running when the contact arm is on-operated and the trigger is not on-operated.

16. The driving tool according to claim 15, wherein the mechanical timer is configured to prevent an on-operation of a contact arm if a reference time since the mechanical timer mechanism has been activated has elapsed.

17. The driving tool according to claim 16, wherein the trigger is configured to reset the mechanical timer mechanism when the trigger is off-operated.

* * * * *